United States Patent [19]

Christen et al.

[11] 4,390,869

[45] Jun. 28, 1983

[54] GAS SENSING SIGNALING SYSTEM

[75] Inventors: Peter Christen, Männedorf; Peter Müller, Oetwil, both of Switzerland

[73] Assignee: Cerberus AG, Männedorf, Switzerland

[21] Appl. No.: 225,097

[22] Filed: Jan. 14, 1981

Related U.S. Application Data

[63] Continuation-in-part of Ser. No. 54,786, Jul. 5, 1979, abandoned.

[30] Foreign Application Priority Data

Jul. 17, 1978 [CH] Switzerland ..... 7721/78

[51] Int. Cl.[3] ..... G08B 17/10

[52] U.S. Cl. ..... 340/632; 340/521; 340/634

[58] Field of Search ..... 340/632, 633, 634, 521; 73/204, 27 R; 422/94, 95, 96, 97, 98

[56] References Cited

U.S. PATENT DOCUMENTS

| | | | |
|---|---|---|---|
| 3,573,777 | 4/1971 | Kompelien | 340/629 |
| 3,599,195 | 8/1971 | Boyko | 340/521 X |
| 3,688,293 | 8/1972 | Sullivan | 340/521 X |
| 3,815,114 | 6/1974 | Johnson et al. | 422/95 |
| 3,909,813 | 9/1975 | Scheidweiler et al. | 340/629 X |
| 3,952,294 | 4/1976 | Emerson et al. | 340/629 X |
| 4,064,498 | 12/1977 | Burr et al. | 422/94 X |

*Primary Examiner*—John W. Caldwell, Sr.
*Assistant Examiner*—Daniel Myer
*Attorney, Agent, or Firm*—Frishauf, Holtz, Goodman & Woodward

[57] ABSTRACT

A gas sensing signaling system is provided in which a plurality of gas sensing units are connected over cables with a central station. To permit establishment of threshold levels such that false alarms are rejected while the system still remains sensitive to dangerous conditions and to permit ready supervision and testing of said system, a central station is provided in which timing circuits are included which start the time interval upon sensing of an alarm condition above a lower, or warning threshold level. If the lower warning level signal persists for the timing interval—for example for about one-half minute, a warning signal is given. A higher level signal generates an alarm signal, either immediately or after a much shorter time delay. The circuit includes self-holding circuitry so that, once a sensing unit transmits a sensing signal which persists beyond the previous predetermined warning or alarm time duration, the central station will indicate the respective conditions until manually reset. Besides indication, corrective action, such as energization of ventilation equipment and the like can be controlled. The cabling system preferably operates with predetermined, discrete voltage levels at the respective signal lines which, upon transmission of a warning and/or alarm signal, changes under control of a voltage control circuit in the central station, to permit additionally, by connection of a termination element, to indicate malfunction within the lines or the sensing units by detecting current flow and voltage relationships in the respective lines.

44 Claims, 13 Drawing Figures

GAS SENSING SIGNALING SYSTEM

This application is a continuation-in-part of application Ser. No. 54,786 of July 5, 1979, now abandoned, claiming priority of Swiss application No. 7,721/78-9, July 17, 1978 now abandoned.

The present invention relates to a gas sensing signaling system in which a plurality of gas sensing units are connected over cables with a central station. Upon response of one of the units to a gas which is to be sensed, a signaling system is enabled which signaling system has two discrete signaling indicators: a warning indication and an alarm indication, the warning indication providing a warning output if gas above a first lower threshold, but below a second higher threshold level is present; and an alarm indication providing an alarm output if gas above the second threshold level is present.

BACKGROUND AND PRIOR ART

It has previously been proposed to determine the presence of gases by providing gas sensing units which contain gas sensing elements which change their electrical characteristics when the gas to be determined is present in the ambient atmosphere. Such gas sensing elements can provide an indication of the presence of carbon monoxide, methane, or specific gases such as butane or propane, as well as indicate the presence of gas mixtures, such as natural gas, coal gas, distillation gases, and the like. Other gas sensing elements are known which respond to toxic gases, vapors of organic solvents, combustion gases and the like. The change of the electrical characteristic of the sensing element occurs, e.g. due to interaction of the gas to be sensed with the element itself or for example based on catalytic oxidation of the gases which generate heat. Elements operating in this latter manner are e.g. the so-called pellistors. Various gas sensing elements are known which operate according to various physical and chemical principles, which may differ from each other; some gas sensing elements use metal oxide semiconductors. Gas sensing elements which can be used in the system of the present invention are described for example, in U.S. Pat. Nos. 3,695,848; 3,609,732; 3,676,820 and 3,644,795. The sensors there described change their electrical resistance when exposed to gases which can be oxidized, that is, to combustible gases.

Gas sensing units of whatever type are usually connected with connection lines to a central station. If the gas concentration exceeds a predetermined value, alarm devices are enabled by the central station to provide an alarm to personnel and, if desired, corrective counteraction may also be taken, for example by starting ventilators, exhaust apparatus, opening emergency exits, ventilation flaps, explosion suppression systems, water flooding systems, and the like.

Gas sensing systems as heretofore customarily used have the disadvantage that they may respond to "false alarms". The response thresholds of the gas sensing units must be set to be quite low, particularly when toxic gases are involved, so that corrective or emergency action can be taken even if the concentration of such gases is low or may occur only for a short period of time. Unnecessary, and hence undesired alarms may be given, however, due to spurious response of an element, random localized concentration of the gas to be sensed close to the sensing element, and the like; such false alarms interfere with effective use of the system and impair its reliability and its efficacy as an alarm unit.

It has previously been proposed—see German Patent No. 1,598,798—to use signaling systems having two different thresholds, in which, when the lower threshold is exceeded, a warning signal is provided and only when a second and higher threshold is reached, will an alarm signal be given. The circuit arrangement as there described is a combination of gas sensing element and evaluation circuit in form of a functionally single gas detection device. Such arrangements are not suitable for use as components in an overall gas sensing signaling system which is a composite of a plurality of gas sensing units and an evaluation or central station. If a plurality of such single devices are to be supervised, the respective devices have to be individually looked for the checked, and optical indication of which device has responded is not provided for. Further, if a device responds, and the response characteristics then disappear, it is impossible to locate which device has responded to correct any possible incipient malfunction in the elements supplying the gas which was sensed. By use of two thresholds, it is possible to set the alarm threshold higher than the warning threshold and thus to partially overcome the defect of prior systems of generation of unnecessary false alarms, at least in part. Yet, since the warning threshold then must be set lower than the previous single threshold, the generation of false warning signals becomes a greater factor.

THE INVENTION

It is an object to provide a gas sensing signaling system in which a central station is provided which can control a plurality of gas sensing units which can be individually connected, or combined in groups, in which the efficiency of operation is increased, and the reliability is such that false alarms or false warning signals are effectively suppressed while still providing warning and alarm signals when they are actually necessary, in other words, to be capable of reliably and effectively distinguishing between casual or short-time small concentrations of the gas or gases to be sensed and a true alarm situation. Additionally, the system should be fail-safe, that is, self-supervising, and indicate malfunction within components of the system as well as warning or alarm situations, and be so arranged that the sensing unit or group of sensing units which generated the alarm can be readily determined. Furthermore, it should be possible to test the system in an easy and reliable way.

Briefly, timing stages are provided which start a timing interval upon sensing of an alarm condition above a first, and lower warning threshold stage. This warning signal is transmitted to the central station. If the signal above the first threshold level persists for the duration of the timing interval as determined by the timing stage, then the warning signal will lock in and be indicated at the central station, even if the sensing will then disappear, and provide not only a warning signal but also an indication which one of the sensing units provided the warning signal. A suitable time is, for example, about ½ minute. If the gas concentration rises to a higher threshold level, an alarm signal will be triggered. The alarm signal, likewise, can be subject to a time sensing, that is, the higher threshold level may have to persist for a predetermined period of time. This timing period will be short with respect to the timing period for the warning signal, several seconds for example, in order to suppress spurious responses, but it may also be zero.

Drawings, illustrating a preferred example:

Figure 5A:
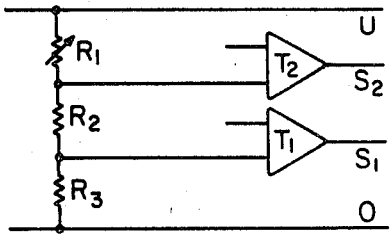
Figure 5B:
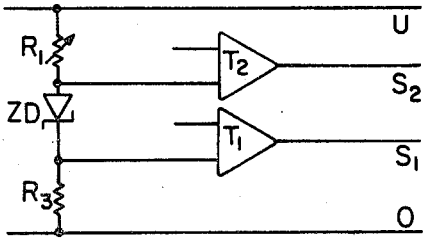
Figure 5C:
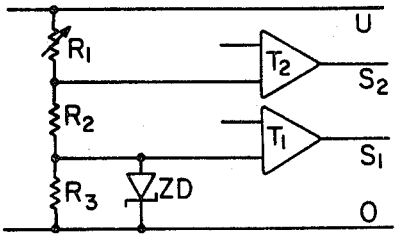
Figure 6:
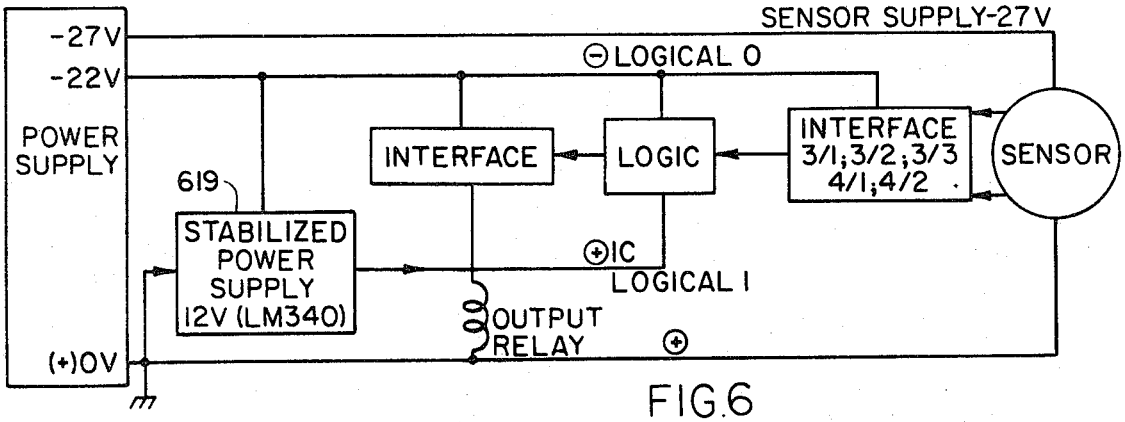
Figure 7:
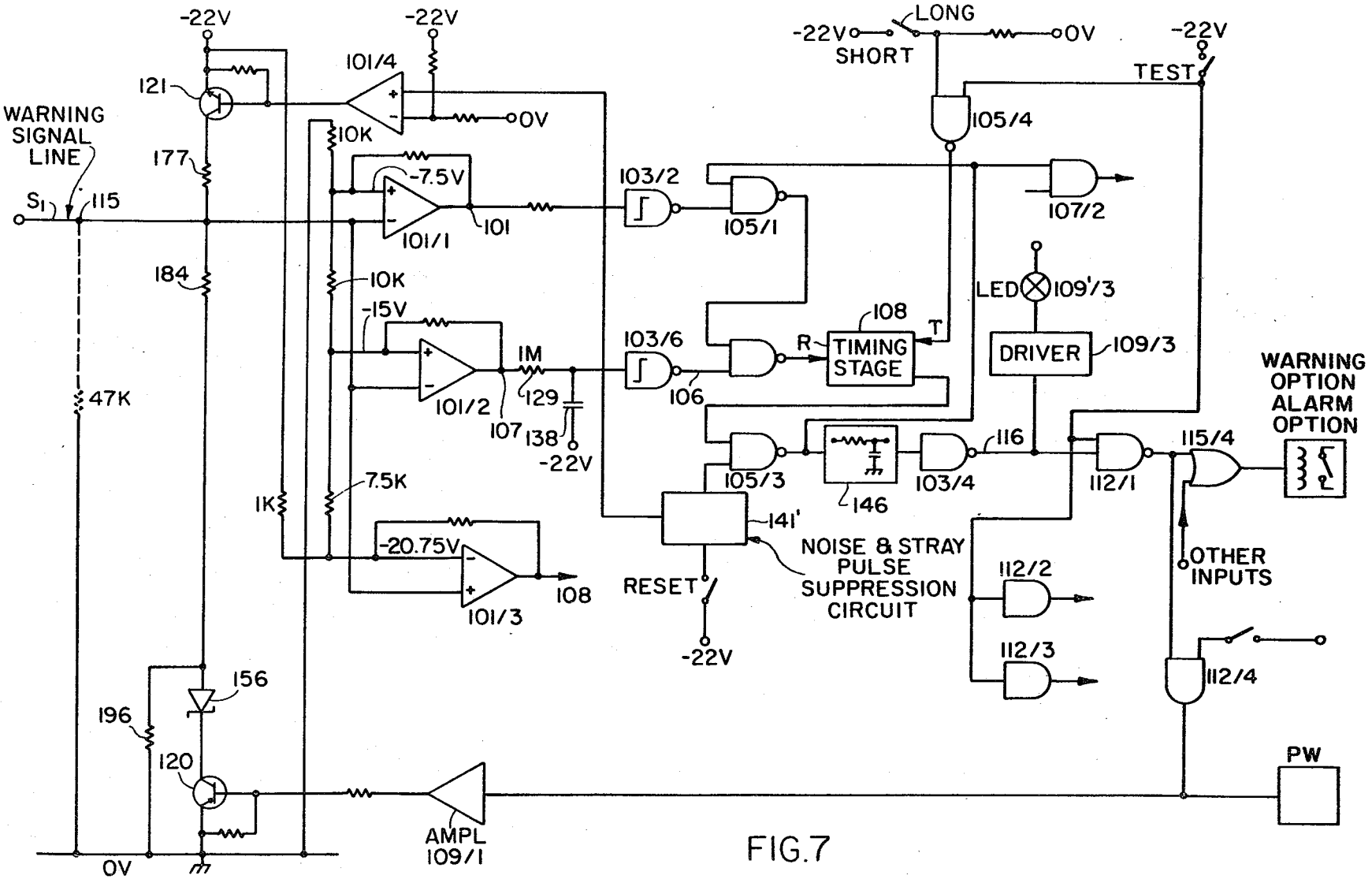
Figures 8, 9:
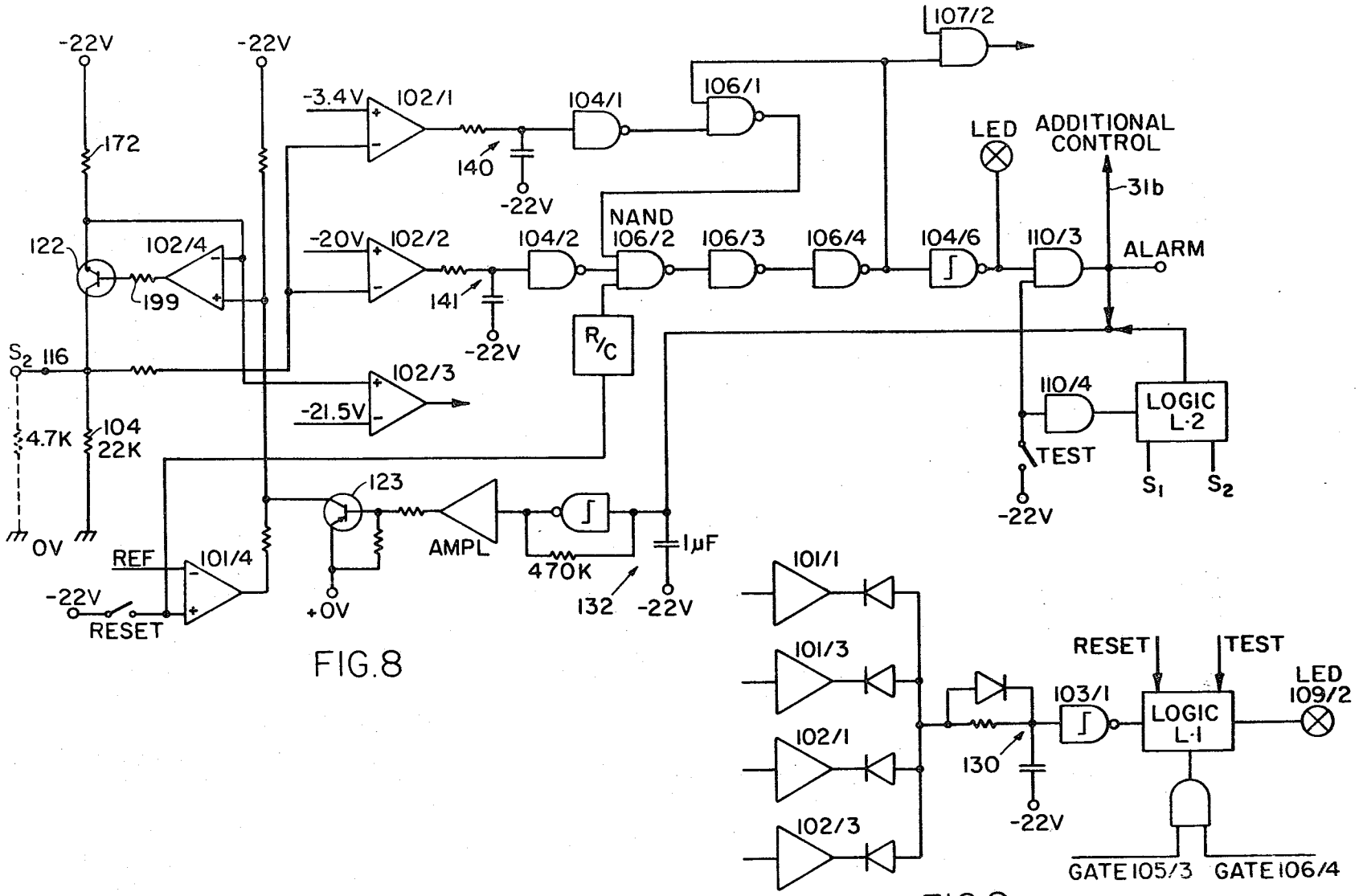

FIGS. 5*a* to 5*c* are highly schematic circuit diagrams of various circuits to determine the threshold levels of response of the respective gas sensing units;

FIG. 6 is a schematic circuit diagram of the arrangement of the circuit paths in the central station;

FIG. 7 is a highly schematic circuit diagram of the warning signal path in the central station;

FIG. 8 is a highly schematic circuit diagram of the alarm signal path in the central station;

FIG. 9 is a fragmentary diagram tying in the diagram of FIGS. 7 and 8 and illustrating, highly schematically, the malfunction signal path in the central station.

Figure 10:
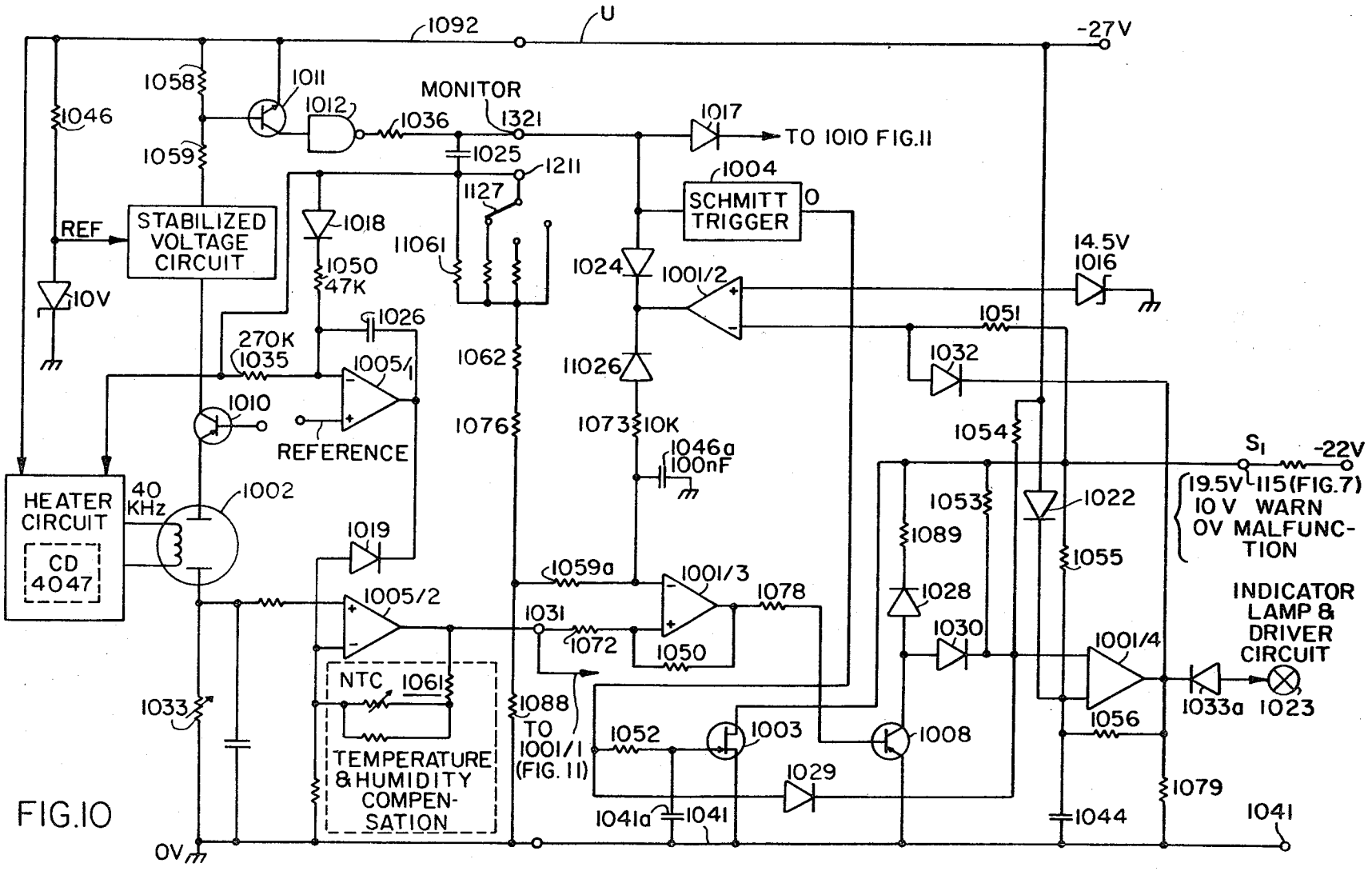
Figure 11:
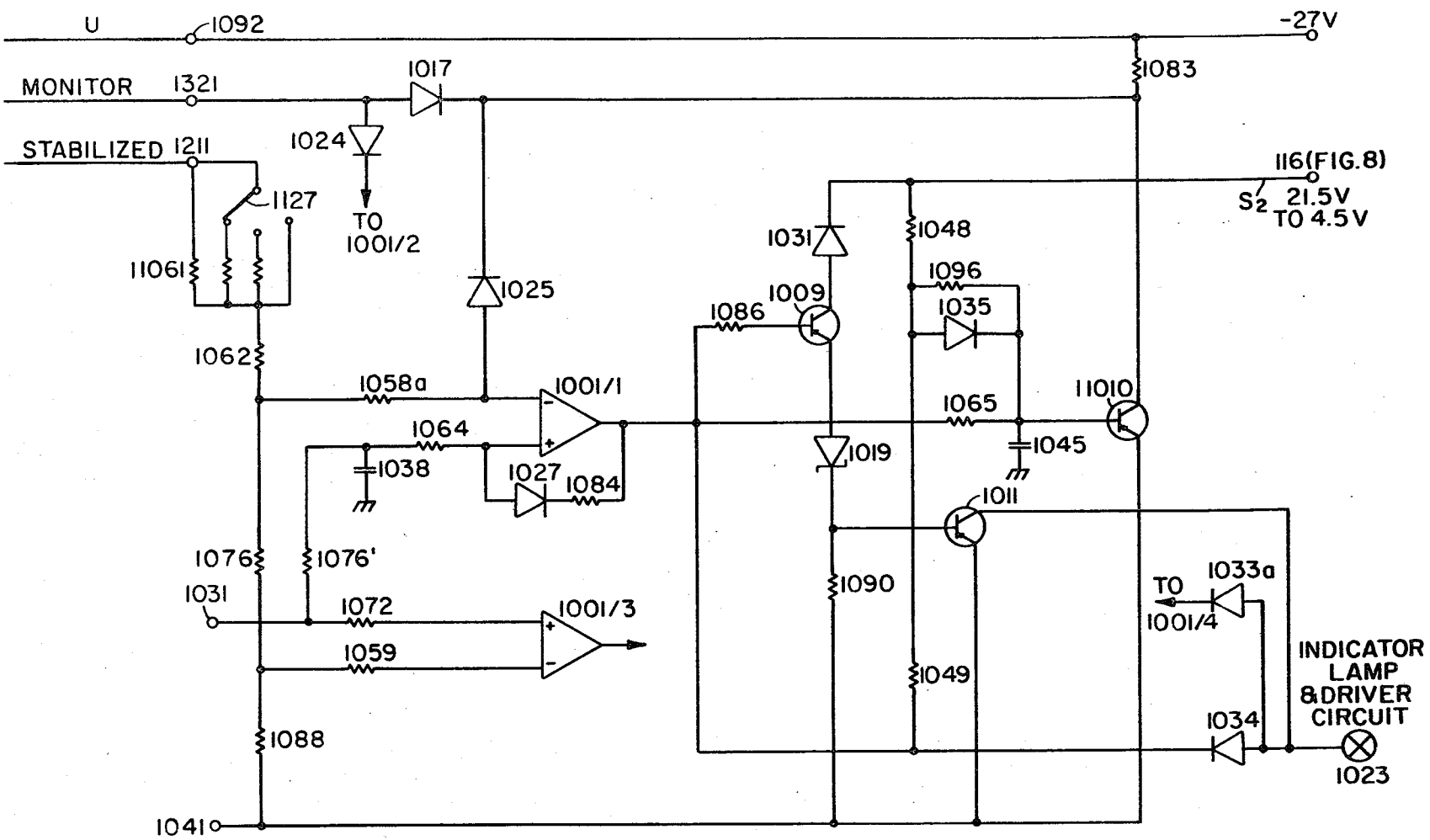

FIG. 10 is a highly schematic diagram of a gas sensing unit and illustrating the sensor portion, the warning signal, and the sensor malfunction or monitoring paths; and FIG. 11 is a highly schematic diagram of the alarm signal path of a sensing unit.

A central station C is connected by a cable in which the main lines are indicated in single-line diagram with a plurality of gas sensing units $G_1 \ldots G_n$. The respective gas sensing units are connected in parallel to the cable. The cable has a power supply line U which supplies power to the respective gas sensing units, a warning signal line pair $S_1$, an alarm signal line pair $S_2$, and a ground or chassis or reference bus O. Rather than using line pairs, single lines may be used with a common return, and suitable decoupling circuits.

The cable U-$S_1$-$S_2$O extends throughout the area to be supervised and terminates in a termination element E. The respective gas sensing units $G_1 \ldots G_n$ are connected to the cable in parallel.

Each one of the sensing units $G_1 \ldots G_n$ has one or more indicating and control units $L_1 \ldots L_n$ connected thereto, which are secured to the sensing unit itself, or placed in the vicinity thereof for example at a clearly visible location. These units $L_1 \ldots L_n$ can be constructed as optical or acoustic signaling devices, such as lights, flashing lights, horns, or the like; additionally, control units can be coupled thereto to operate protective systems such as ventilators, exhaust blowers, sprinkler systems, and the like.

The central station C has a warning stage W coupled thereto, an alarm stage A, and a malfunction indicating stage F. Each one of these stages can provide for optical and/or acoustical indication and, if necessary, to automatically control remedial action, for example connection of a fan, operation of one or more valves, sprinkler systems, or the like.

Termination element E which is connected to the end point of the cable system to which the respective units $G_1 \ldots G_n$ are connected supervises the intregrity of the cablings between the central station and the respective gas sensing units. In case of a defect, such as an open circuit or a short circuit, of the ground bus O or one of the signal lines $S_1$, $S_2$, the termination element E will cause the malfunction indicating stage F at the central station C to provide a malfunction signal. The power supply line U as well as the respective sensing units $G_1 \ldots G_n$ likewise can be supervised with respect to defects or malfunction, by including an electronic circuit which supervises or monitors proper operation of the gas sensing units. In case of defect or malfunction this electronic circuit short-circuit, for example, one of the signal lines $S_1$ or $S_2$ and the termination element E will provide an indication to the central station C to then enable the malfunction indicating stage F.

The sensing units can be grouped in various ways, that is, for example a group of sensing units can be connected to one cable, and another group of sensing units to another cable, which cables can be connected to various inputs at the same central station, for example to indicate respectively different phenomena; thus, for example, one group of sensing units connected to one cable can be provided to supply an indication at a warning and alarm level, respectively, upon sensing of toxic gases; whereas another group of sensing units connected to another cable and to another input at the central station can provide an indication of the presence of combustible gases, such as methane. The central station then will provide, at respective inputs for the respective sensing units respectively different warning and/or alarm indications indicative of the respective gas which was snesed.

The gas sensing units $G_1 \ldots G_n$ have included in the units means to detect and provide signal transfer of sensed signals of at least two threshold levels, representative of threshold levels of the gases being sensed and of analog response levels of the respective sensing element. Additionally, the sensing units are so arranged that malfunction in the unit itself, for example an open or short circuit of the sensor, can be signaled to the central station. More than two sensing thresholds can be provided, for example a first, very low sensing threshold coupled to a timing stage having a long time interval; an intermediate threshold level with a shorter timing interval, and a final, and alarm sensing threshold. Each one of the threshold levels then will have its own signal line or signal line pair associated therewith, similar to the lines $S_1$, $S_2$. It is, of course, also possible to use different kinds of signals on the same line. Increasing the number of thresholds introduces additional complexity and decreases reliability. For most systems, two threshold levels are sufficient and, in view of the increased reliability in rejection of false alarms, preferred.

Figure 2:
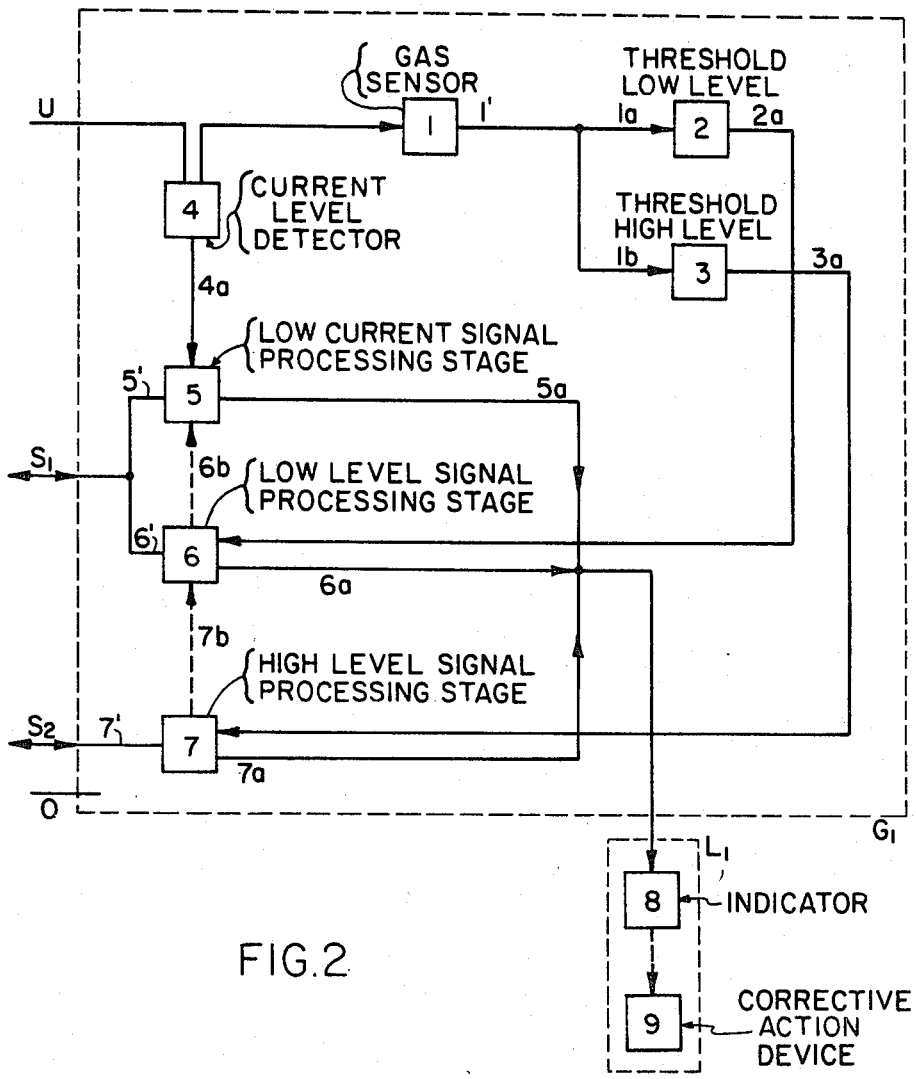
FIG. 2 is a block circuit diagram of a gas sensing unit.

The gas sensing unit is shown in FIG. 2; the various elements are shown in block form and the particular components of the blocks, themselves, are well known and may be constructed in accordance with standard circuit technology and, preferably, in the form of integrated circuit units.

A gas sensor 1 is provided which may be a sensing element as well known and described in connection with the prior art. The gas sensor 1 has an output signal 1' which is applied to a low-level threshold circuit 2. The low-level threshold circuit 2 has an output signal 2*a* which is connected to a low-level signal processing stage 6 which, in its simplest form, comprises an amplifier providing a response output when triggered by the threshold circuit 2 and a voltage sensing circuit checking the voltage on line $S_1$. The signal processing stage 6 has an output signal 6*a* which energizes the indicator and control unit $L_1$. Indicator and control unit $L_1$, just like the other indicator and control units, includes an indicator 8, for example a light-emitting diode (LED), an acoustic indicator, and the like; and, if desired, a control unit 9 which energizes a corrective action device, for example an exhaust ventilator. Operation of the indicator 8 and of the control unit 9 is self-canceling, that is, when the low level threshold signal 2*a* disappears, the low-level signal processing stage 6 likewise no longer provides an output signal 6*a*. Thus, when the output signal 1′ from the gas 1 drops below the level 1*a*, stage 6 no longer provides an output signal 6*a*.

Figure 3:
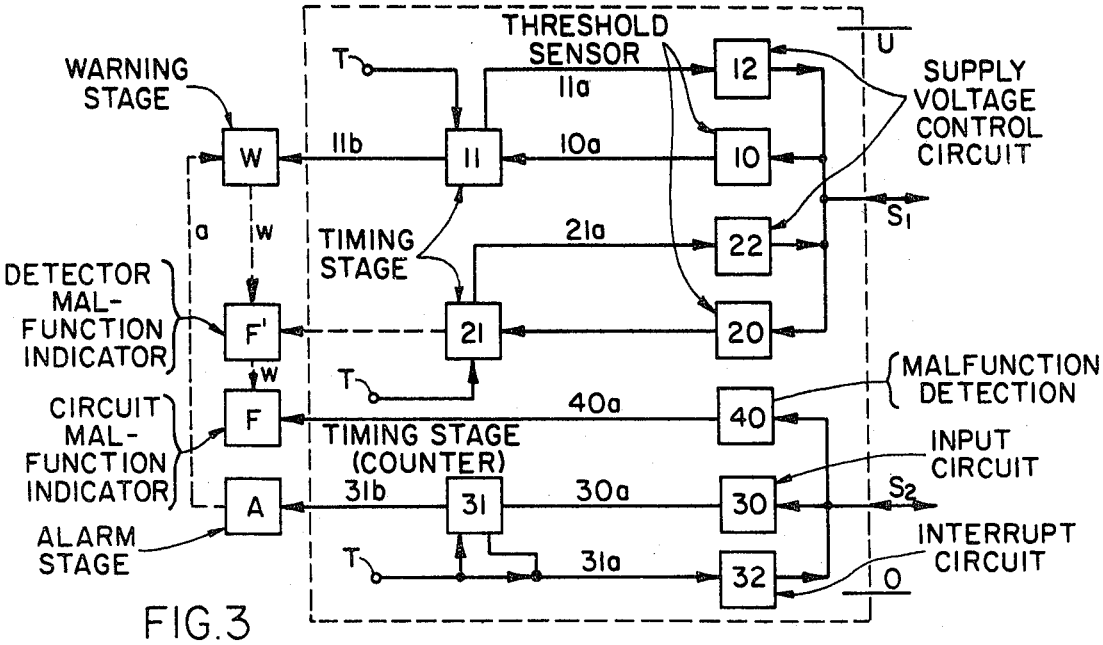
FIG. 3 is a block diagram of the central station.

The output signal 6′ is transmitted over the signal line $S_1$ to the central station C (FIG. 3). The stage 6, when deenergized, may have for example a certain resistance which causes a voltage across the line $S_1$ and O to be in the order of, for example, 20 V. When the stage 6 responds, the resistance of the stage changes, for example, due to conduction of a transistor therein, so that the generated signal 6′ forces the voltage at line $S_1$ to drop for example to 10 V. Thus if one of the sensing units, e.g. $G_1$ has responded, then the line $S_1$ which connects all the sensing units will have a voltage of 10 V thereon, so that the voltage sensing circuit of the stage 6 of a second sensing unit inhibits the corresponding signals 6*a* and 6′, if the corresponding low level threshold signal 2*a* is present and thus disables the activating of the indicator and control unit of said second sensing unit. In other words, the generation of the output signals 6*a* and 6′ of each sensing unit $G_1 \ldots G_n$ depends on a "clear" line $S_1$ connecting all the low-signal processing stages 6 to the central station; if the voltage at line $S_1$ to or from any one of the units already is at the low level, further output signals 6*a* and 6′ of any further sensing unit are inhibited. Thus, simultaneous response of a plurality of indicator and control units $L_1 \ldots L_n$ within the same group of units connected to one cabling system is prevented; and the first unit which has responded is indicated.

The change in resistance across line $S_1$-O, due to response of one of the units 6—for example by controlling a transistor, a thyristor, or other semiconductor element to conduction, is detected in the central station C (FIG. 3) by a warning signal input circuit 10, which will generate a response signal 10*a*. The response signal 10*a* starts a timing duration of a timing stage 11. If the signal from the low level signal processing stage 6 that is, the signal 6′ on line $S_1$ (FIG. 2) and consequently the signal 10*a* persists for the timing duration—for example about ½ minute—then the timing stage 11 will provide output signals 11*a*, 11*b*. If, however, the signal 20*a*, due to the response of the circuit 10 and stage 6 (FIG. 2) ends before the time duration. signal 11*b* as well as signal 11*a* will not be generated. Let it be assumed that the gas concentration at the level causing an output signal 1*a* of the gas sensor 1 (FIG. 2) persists for the timing duration of stage 11; signal 11*b* will be generated and warning stage W will be activated. Additionally, signal 11*a* will be generated. Signal 11*a* is a feedback signal which controls a supply voltage control circuit 12 which will drop the voltage on the line $S_1$ to maintain the voltage at the lower level, for example 10 V, regardless of the later state of any one of the gas sensors 1 in any one of the other units $G_1 \ldots G_n$, until manually reset. Thus, the condition of all the sensing units with respect to the signal line $S_1$ are "frozen", that is, upon response of the lower stage 6 of the respective sensing unit, persisting longer than the timing duration of stage 11 the sensing indication becomes self-holding, the sensing unit indicator $L_1$ will continuously indicate, even if the gas concentration as sensed by the specific gas sensor 1 drops below the threshold level of the signal 1*a*. Simultaneously, reponse of any one of the other sensing units is inhibited.

The warning stage W can be any suitable warning element, such as an optical and/or acoustical signal arrangement with or without automatic corrective action devices, such as ventilators, shut-off elements for valves, switches, and the like.

Referring again to FIG. 2: If the gas concentration should rise further, so that the output signal 1′ from gas sensor 1 reaches a higher threshold level 1*b*, corresponding to a higher threshold set in threshold circuit 3, threshold circuit 3 will provide an output signal 3*a* to a high-level signal processing stage 7, which may be similar to the stage 6. The signal 7*a* is also connected to the output signal 6*a* of the low-level signal processing stage 6 to additionally operate the indicator 8. The signal may be different from that when stage 6 has responded, for example by causing the signal from stage 6 to become intermittent, to add or change the color of the output, change the intensity, frequency, or otherwise to indicate that stage 7 has additionally responded. Generation of an output at unit $L_1$ is independent of presence of a signal already on the line $S_1$ from the specific sensing unit, or due to response of another sensing unit. The signal 7′ from signal processing stage 7 on line $S_2$ is self-locking or self-holding—as will appear, even if the gas concentration should drop below the upper threshold level indicated by signal 1*b* from the gas sensor 1. The signal 7′ on line $S_2$ can be similar to that on line $S_1$, for example by an increase in current, a drop in voltage, e.g. by means of a Zener diode, or the like. The signal can, likewise, be so connected that response of more than one signal processing stage 7 on any other sensing unit is prevented.

In an actual system, therefore, it may be possible that a sensing unit detects a low-level concentration for a persistent period of time, exceeding the timing duration of stage 11, and provides a warning signal, and locks the respective sensing unit in position. Simultaneously, a ventilation element associated with the sensing unit is placed in operation. Another sensing unit would likewise sense the lower level of concentration but, since it is inhibited by response of the first sensing unit, the concentration there will rise until the second, or higher, or alarm thereshold level is reached, and then will provide the alarm output from another sensing unit and consequent enabling of a corrective action device, if provided.

The high level signal processing stage 7 may either operate together with stages 30, 31, 32 in a self-holding manner analogus to the operation of the low level stages 6, 10, 11, 12 or in a self-locking manner. In this case, the processing stage 7 is self-locking.

The resulting signal 7′ on line $S_2$ is transmitted to the central station C (FIG. 3) where it is tested for genuineness, that is, if the signal truly is one provided by the high-level signal processing stage 7. The signal is transmitted to an alarm signal input circuit 30 which, in its simplest form, may be a voltage sensitive amplifier, or the like. The output signal from circuit 30 is connected to a timing stage 34 comprising counter and timer circuits. The rising flank of the signal 30*a* causes said counter-circuit to step by one count and provide an output signal 31*a* which is fed to a supply voltage control circuit 32 which briefly interrupts the voltage on line $S_2$ and thus releases the self-locking feature of the signal processing stage 7—that is, it causes the condition of the line $S_2$ to revert to the previous "no signal" stage. If the signal 7' on line $S_2$ reappears within a predetermined period of time, determined by said timer circuit of the timing stage 31, for example 10 seconds, the counter circuit of the timing stage 31 is caused to count a second signal thus providing an output 31*b*, which operates the alarm stage A. Otherwise, said counter circuit will be reset after said predetermined period of time.

The timing stage 31 can be constructed in various ways; for example, the interrupt duration of the supply voltage control circuit 32 can be set to be very short—e.g. 1 second—and the counter circuit of the timing stage 31 can have a plurality of count stages and if a predetermined count stage—for example a count stage of four—is obtained in said predetermined period of time—for example 10 seconds—the output signal 31*b* is generated. The particular arrangement of the timing stage 31 and the interrupt duration of the supply voltage control circuit 32 can be matched to the particular type of gas to be sensed, the individual gas sensor 1, and its response characteristics, and are matters of design for a specific system to sense specific gases.

The cabling system U-$S_1$-$S_2$-O which connects the central station to the respective sensing units $G_1 \ldots G_n$ is supervised by the termination element E (FIGS. 1, 4) and utilizing the signal line $S_2$ for transmission of the appropriate signals between the central station C and the termination element E. A malfunction signal is detected in malfunction detection circuit 40, which will generated an output signal 40*a* which is directly transmitted to the malfunction indicating stage F.

The respective sensing units $G_1 \ldots G_n$ are supervised for malfunction by sensing proper current flow through the sensing element. The respective sensing units $G_1 \ldots G_n$ (FIG. 2) have a current sensing element 4 included in the main supply line which may, for example, be a transistor or the like, which provides an output signal if the current flow through the respective sensing element 4 is not at a predetermined or appropriate level. The resulting output signal 4*a* is applied to a malfunction signal processing stage 5 which, essentially, has the same function as the low-level signal processing stage 6, and controls the indicator unit $L_1$ by the signal 5*a*, and additionally generates a signal 5' which is similar to the signal 6' and controls the central station C (FIG. 3) as if the signal 6' were applied thereto, in the same function and manner, by preventing respoinse of another sensing unit, and providing for self-holding after the timing interval set by timing stage 11. In order to distinguish between response of the low level signal processing stage 6 and the malfunction signal processing stage 5 the signal 5' may be substantially lower than the signal 6'; thus, in a preferred form, the normal voltage on line $S_1$ absent response of any sensing unit is in the order of 20 V; response of a sensing unit drops the voltage to 10 V. Malfunction indication, however, provides almost a short circuit and the signal 5' drops the voltage on line $S_1$ to, for example, 3 V. This drop in voltage causes response of the termination element E, and consequent response of the malfunction detection circuit 40 and then response of the malfunction indicating stage F. Response of the malfunction detection circuit will be explained below in connection with the details of the termination element E and its operation.

The circuits 20, 21, 22 in the central station C, FIG. 3, and the signals generated thereby are similar to the circuits 10, 11, 12 and operate the same way, except that the supply voltage control circuit 22 will be responsive to a value of 3 V, that is, to the signal 5' and that, rather than providing its output to the warning stage W, a sensing unit malfunction indicating stage F' is activated. The stage F' and the circuits 20, 21, and 22 are not strictly necessary if the termination element E is used. The designer, thus, has a choice: to utilize the termination element E and the malfunction indicating stage F to provide a single and self-canceling malfunction indication which will indicate both cabling malfunction and a sensing unit malfunction without, however, distinguishing therebetween; or slightly increased complexity and duplication of elements 10, 11, 12 by the elements 20, 21, 22 and providing a self-holding indication of sensing unit malfunction and together with F' a separate indication so that malfunction between cabling and a sensing unit can be distinguished.

The system additionally provides an overall test control to test the various functions; when making tests, the time delay and self-holding and self-locking features are undesirable.

The present system easily permits making of effective tests to determine functional operability of the respective elements, particularly of the sensing units. This is readily accomplished since the important delay and self-holding circuits are all located in the central station and not in the sensing units themselves; or, if located in the sensing units, are controlled from the central station, such as, for example, the reset in case of a self-locked high level signal processing stage 7 by the supply voltage control circuit 32 which affects the line $S_2$, and hence the self-locked signal 7'. To provide a system test, test circuit means T (FIG. 3) are provided to give an override signal to the timing stages 11, 21 (if provided), 31 so that the respective signals 11*a*, 21*a* and 31*a* become ineffective, thus preventing the self-holding feature of the corresponding circuits 12, 22 (if provided), 32. In case of said self-locking manner of stage 7, said override signal is also applied to the timing stage 31 thus activating the interrupt line signal 31*a*. The signals 11*b*, 21*b* and 31*b* are suppressed, thereby eliminating an undesired signaling of the central station by the group being tested, by merely interrupting the circuit thereto; if the optical/audible and other warning systems likewise are to be tested, then this override can be omitted.

Priority of output indication for the various output signals: "malfunction"; "warning"; "alarm" is done in the central station C and/or in the sensing unit itself by selectively, cross connection A and W in the central station (FIG. 3) or, respectively, cross section 6*b*, 7*b* (FIG. 2) in the sensing units between the respective circuit components. Since the "priority" between the circuits 5, 6 or 7, 6 in the sensing units or, similarly, between the stages A, W, F and F' in the central station C (FIG. 3).

Figure 4:
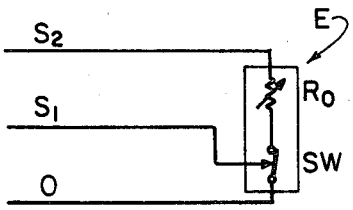
FIG. 4 is a highly schematic circuit diagram of a termination element.

The circuit of the termination element E is shown in FIG. 4; it may be constructed in various ways, for example as a resister, as a Zener diode, as an active termination element, or the like, which tests presence of a signal and notifies the central station C to activate the malfunction detection circuit 40 therein. The circuit of E is connected, basically, between the signal line $S_2$ and the ground bus O. If the normal signal on line $S_2$ should cease, the malfunction detection circuit 40 is activated which, in turn, activates the malfunction indicating stage F (FIG. 3). Preferably, but not necessarily, the termination element E also contains an electronic, controlled switch SW, for example a thyristor, another semiconductor element such as a transistor, or the like, connected to be controlled by a signal on the signal line $S_1$. If the voltage at the line $S_1$ has a certain minimum value, for example 5 V or more, the switch SW is closed; if a transistor, it is controlled to be conductive. The "signal present" signal between line $S_2$ and O thus can be transmitted to the central station and malfunction detection circuit 40 will not respond. If, however, the voltage at line $S_1$ should drop, either by being interrupted, that is, if the line is broken anywhere between the termination element E and the central station, or there is a short circuit, or if due to malfunction in any one of the units themselves, the voltage at the line $S_1$ drops to the low level of for example 3 V, switch SW will open—if a transistor, will switch over to blocked condition—and further transmission of a signal between the lines $S_2$ and O is blocked. This lack of a closed resistive circuit is detected in the detection circuit 40 (FIG. 3) in the central station so that the malfunction indicating stage F will be immediately activated to indicate a line, and/or sensing unit defect. The power supply line U is checked automatically by the test or check circuit which is included in the sensing units $G_1$ . . . $G_n$ themselves, since loss of supply voltage will be detected by the current sensing elements 4 in the respective sensing units—see FIG. 2—and thus a malfunction indication will be provided to cause the malfunction indicating stage F in the central station to be activated.

The threshold levels of the gas concentration to which the various gas sensing units respond can be set, continuously or in steps, to match expected conditions.

FIG. 5, collectively, and specifically the respective FIGS. 5*a*, 5*b*, 5*c*, show various ways of setting the threshold levels within the gas sensing units, and also simultaneous adjustment of both threshold levels, so that gas sensing units can be constructed in standard form, with individual adjustments being made in the field, without requiring circuit changes.

The circuit of FIG. 5 utilizes an input circuit which is a voltage divider, for example three resistors $R_1$, $R_2$, $R_3$. Preferably, at least one of the resistors is adjustable—$R_1$ being suitable, as shown. The resistors themselves need not be resistor elements but can be replaced by other resistive components, such as a Zener diode ZD (FIG. 5*b*), the equivalent circuit of which is a like resistor $R_2$ in FIG. 5*c*. The Zener diode may also be connected in parallel to one of the resistors, for example $R_3$ (FIG. 5*c*). The two tap points of the voltage divider are connected to the reference inputs of operational amplifiers connected as threshold level detectors $T_1$. $T_2$. The other inputs to the operational amplifiers, which function as comparators, are connected to the output of the respective gas sensing element 1, to receive the signal 1', so that at comparator $T_1$, signal $\mathbf{1}_a$ will appear, and at comparator $T_2$, the signal $\mathbf{1}_b$ will be placed. These signals are analog-output signals derived directly from the gas sensing element, and detect corresponding changes in resistance of the gas sensing element upon sensing the presence of gas to which they are sensitive. The outputs of the respective comparators $T_1$, $T_2$ then form the output signals 2*a*, 3*a*, respectively, which in due course and after processing in the respective stages 6, 7 are transmitted over the lines $S_1$, $S_2$ as shown schematically in FIG. 5. By changing the resistance value of the resistor $R_1$, a change of sensitivity of the respective threshold levels is obtained. In accordance with the embodiment of FIG. 5*a*, the change of sensitivity will be proportional for both threshold levels in that the change of resistance of resistor $R_1$ will simultaneously proportionately shift the concentration levels at which the comparators $T_1$, $T_2$ will respond. In the example of FIG. 5*b*, both threshold levels are shifted in parallel at least in a portion of the adjustment range. This combination permits compensation for non-linearities of the gas sensing elements 1 within a wide range. The system of FIG. 5*c* results in, initially, a proportional shift of both threshold levels until the breakdown level of the Zener diode ZD is reached; thereafter, the lower threshold level remains constant and at the level predetermined by the Zener diode ZD. By connecting the Zener diode ZD to a voltage divider formed of two elements, that is, splitting resistor $R_3$ into two components and connecting the Zener diode to a tap, and making at least one of those components adjustable, further adjustment of the threshold level can be obtained. Various changes and modifications of the threshold level setting arrangements may be made, as well known in connection with threshold detectors.

The invention has been described with reference to two threshold levels, a lower and an upper one; various other intermediate threshold levels could be used, between the lowest and uppermost threshold level to additionally trigger various alarm or warning systems, or different corrective action; thus, the highest level may be set for a catastrophic alarm, including blocking of access to the affected premises; the lowest level can be subdivided, for example, into levels with different degrees of intensity or concentration of the gas being sensed, to result in progressive alarms or progressive corrective action, by introducing additional lines similar to lines $S_1$, $S_2$ and conducting the signals to respective stages which are similar to stages 10, 11, 12 and/or 30, 31, 32, respectively. The timing intervals of the timing stages formed by the stage 11 (FIG. 3) and the stage 31 can then be individually adjusted in accordance with design requirements of the particular system and in the light of the gas being detected and the danger against which the system is to warn. Such a cabling system with more than two signal lines may be supervised by a terminating element E with a plurality of switches SW controlled by the corresponding signal lines.

The different way of electronic processing of the conditions on the two signal lines, as shown, is not absolutely required. The signals on the various lines can both be treated in the same way, as described in connection with any one of them.

Figure 1:
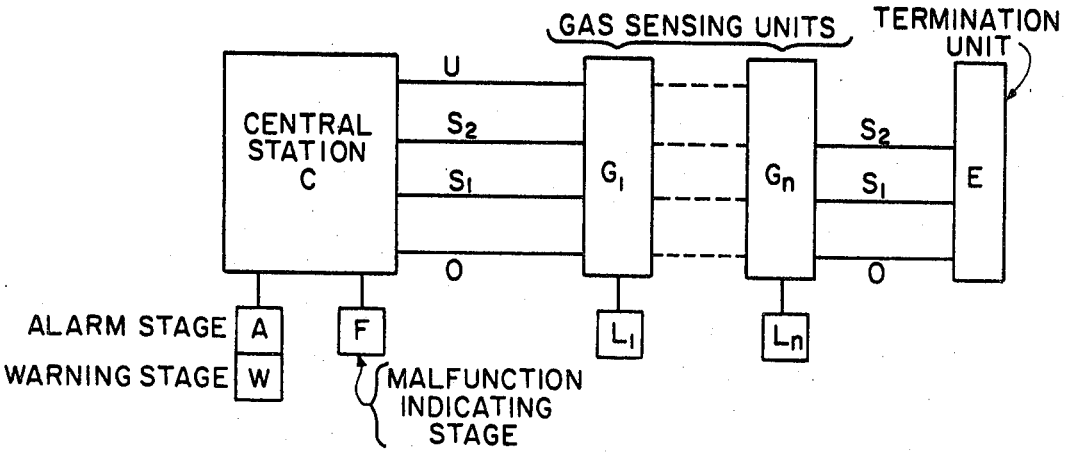
FIG. 1 is a highly schematic diagram of a gas sensing signaling system.

The first stage to respond, giving the warning, can also be constructed to be self-canceling by eliminating the self-holding feature supplied by the supply voltage control circuit 12, which is enabled after elapse of the time set by the timing stage 11 (FIG. 3). Thus, it is only necessary to interrupt or eliminate the output line 11*a* from the timing stage 11. This can be used, for example, if the stage is to be utilized only to connect or control ventilators, venting flaps, and the like, which, after a certain gas concentration has been sensed, can shut off automatically, or after having been in operation for a predetermined period of time determined, for example, by a timing circuit which is energized simultaneously with energization of the respective fan, ventilating louvres or flaps or the like. No signaling of a warning to the warning stage W is then required. Thus, control of such corrective action devices can be obtained directly from the central station as well as at the individual sensing unit. The malfunction detection means can also be constructed to be self-canceling by eliminating the self-holding feature supplied by the supply voltage control circuit 22. The cabling between the central station and the various sensing units can be further expanded, since only signal lines are needed; for example, the cabling may include an additional connection to the gas sensor 1 in the respective units to provide an additional analog output from the sensing unit to indicate, for example, after triggering of an alarm what the actual gas concentration at the individual sensing unit is, so that the respective level of danger at the sensing unit can be accurately determined. It may only be necessary to indicate the highest or peak level of the analog output and, if this is desired, the analog outputs of the sensing units are preferably connected over diodes to a further line—not shown—forming part of the cable between the individual sensing unit $G_1 \ldots G_n$ to the central station C (FIG. 1). Preferably, such an analog signal is enabled only after the corrective action device, such as a ventilator, has started, or only after a warning signal and/or alarm signal has been given in order to ensure that the gases to be sensed and which can then be indicated at the central station will provide an essentially homogeneous ambient atmosphere to the respective sensing unit. The network can be included in the respective sensing units and is, in its simplest form, a peak detector; or it can be connected to the central station where the peak signal is detected in accordance with a well-known peak detection circuit, connected to the additional analog signal line (not shown) of the connection cable.

Various changes and modifications may be made, and features described in connection with any one of the embodiments may be used with any of the others, within the scope of the inventive concept. The sensing units themselves may be of various known types and may include sensing elements utilized, for example, in connection with flow anemometers and using platinum wires, see, for example U.S. Pat. No. 2,726,546, King, Jr., and U.S. Pat. No. 3,603,147, Dorman for analogous systems. Particularly suitable sensing units will be described below in connection with FIGS. 10 and 11. A suitable explosion-proof sensing unit is described in U.S. application Ser. No. 128,529, CHRISTEN et al, filed Mar. 10, 1980, and assigned to the assignee of this application. The various signal processing, evaluation and analyzing stages are described with reference to FIGS. 6 to 9 with respect to the central station, and FIGS. 10 and 11 with respect to a sensing unit particularly suitable for use in the system.

The instrumentation of the system heretofore described can readily be carried out by use of integrated circuits of standard commercial construction, connected in the logic system as explained. Timing circuits can be constructed by use of counters in which recurring count clock signals control the time of stepping of the counter, as well known.

The basic supply and operation of the system with the central station is shown in FIG. 6. The central station as well as the sensing units connected thereto operate with voltage at negative terminal ("positive ground"). The logic circuit internal of the central station preferably uses CMOS integrated circuits. These integrated circuits operate with positive supply voltage. The relatively positive 12 V supply voltage for the CMOS circuits is obtained from the −22 V sensing unit supply voltage from a stabilized voltage supply circuit 69, for example of the type LM 340. Since the logic circuits operate with positive voltage, input and output circuits must be connected over an interface. The output circuits are preferably connected through a relay, which may be mechanical or of the semiconductor type.

The circuit operates with this general relationship: Logical 0: −22 V. Logical 1: −12 V to 0 V.

The central station has, dependent on function, four main paths: The warning signal path, the alarm signal path, the malfunction signal path, and additional circuit paths necessary for "housekeeping" function, connection of supply energy and the like. The additional circuit paths can be arranged in accordance with any well known and suitable configuration, as determined by the circuit components used to carry out the logic functions, as explained, and to propagate the respective signals through the warning signal path, the alarm signal path, and the malfunction signal path, respectively.

The warning signal path S1 (FIG. 7): The line S1 is connected to an input 115 which is connected over a resistor 177 through a transistor 121 to negative supply −22 V. The warning signal line is also connected through a resistor, which may be part of the warning signal line and, for example, having a resistance value of about 47 kOhm to ground or 0 V. The voltage at terminal 115 thus will be about −19.45 V. This signal is applied to the comparison or inverting input of three comparators 101/1, 101/2, 101/3. These comparators, preferably, are operational amplifiers, for example of the type MLM 324, connected as comparators, that is, with resistive feedback from their output, as well known and standard in the art. The direct inputs of the respective comparators 101/1, 101/2, and the inverting input of comparator 101/3 have fixed voltages applied thereto which are derived from a voltage divider connected between the negative supply −22 V and ground, in well known manner and shown schematically in the drawings. The voltage levels at the inputs of the respective comparators are −7.5 V, −15 V and −20.75 V, respectively. The output voltage at the three comparator outputs 101, 107, 108 will be 0 V under normal operating conditions which, for the subsequent CMOS gates 103/2, 103/3 means that a logic 1 is applied. The inputs of the gates 103/1, 103/2, 103/3 are high-resistance inputs, by having resistors of, for example, 1 megohm serially connected thereto, so that the CMOS circuits, with their own internally normally present protective elements, such as diodes, operate as voltage dividers. Thus, the gates 3/1, 3/2, 3/3 simultaneously form input interfaces.

If one of the sensing units provides a warning signal, the voltage at the input 15 will be below 15 V but above 7.5 V. Thus, the output 107 of the comparator 101/2 will have a voltage of −22 V appear thereat. Consequently, the input of the CMOS inverter gate 103/3 will become a logic 0. The output 106 thereof will have a logic 1. This output appears with some time delay due to the presence of the high ohm input resistor 129 and a capacitor 138, connected to the input, to form a time delay circuit. The comparators 101/1 and 101/2 correspond to the threshold sensing stage 10, FIG. 3.

The output, that ist, in case of a warning signal, a logic 1 from terminal 106 is applied to an input of a NAND-gate 105/2.

The path over the inverter 103/2 and the NAND-gate 105/1 is still inactive, since comparator 101/1 is in normal state, that is, will have a logic 0 signal thereon, the output of CMOS inverter 103/2 will be a logic 1, which will mean a logic 1 to the corresponding input of the NAND-gate 105/1 connected to the gate 103/2, since the other input to the NAND-gate 105/1 is still 0, the output from gate 105/1 then will be a logic 1, which is applied to the second input of the NAND-gate 105/2.

Consequently, the output from NAND-gate 105/2 will be a logic 0. The NAND-gate 105/2 is connected to a timing circuit, corresponding to timing stage 11, FIG. 3, for example an IC of the type MC 14541. The timing stage 108 thus is activated by having the logic 0 appear at the reset input R thereof. The time itself is determined by a logic signal applied to the timing control input T of timing stage 108. If the timing signal at input T is a logic 0, the time of the timing stage will be about 2 minutes; if the signal at terminal T is a logic 1, then the time will be, about, 4 seconds. The timing interval of the timing stage 108 can be derived also in different manner, for example by controlling the capacity of an R/C network connected to a multivibrator.

If the central station is in the operating mode "full operation", i.e. if a "TEST" switch connected to an input of the NAND-gate 105/4 is open, this input will be logic 1. Consequently, the state of the timing signal at the input T of the timing stage 108 is determined by the position of the short-long-switch, connected to the other input of NAND-gate 105/4. In its "long" position, signal T will be logic 0, i.e. the time delay is 2 minutes.

After elapse of the timing period of timing stage 108, the output from the timer will have a logic 1 appear thereat, which is applied to an input of NAND-gate 105/3. When the NAND-gate 105/3 has a logic 1 at its input, and if the central station is in normal operating condition, the other input of the NAND-gate 105/3 will also be a logic 1, so that its output will have a logic 0 appear thereat. This signal is applied to a time delay circuit 146, for example an R/C circuit as well known, and inverted in an inverter 103/4 which provides a logic 1 signal at its output, which is the output warning signal line **11*b* (FIG. 3) to trigger a driver 109/3 to energize a light emitting diode (LED) indicator 109'/3. The output 11*b* is additionally connected to an input of a further NAND-gate 112/1, the other input of which is connected to a test switch "TEST", capable of applying −22 V, that is, a logic 0 signal, to the NAND-gate 112/1. Assuming the "TEST" switch to be open, so that the input of the NAND-gate 112/1 is a logic 1, the warning signal applied to the second input thereof additionally energizes through an OR-gate 115/4** a relay "W.opt", in order to provide an optical warning.

The output from the NAND-gate 112/1 is additionally applied to the block PW, indicating additional optical and acoustical warning and to a feedback loop through a driver amplifier 109/1 to control conduction of a transistor 120 which is included in the connection from input line S1 and terminal 115 to the ground or reference terminal 0. When this transistor is rendered conductive, a Zener diode 156 in series therewith, and in combination with resistors 184, 196, will clamp the voltage at the input terminal 115 to about 10 V. Thus, the warning signal at the comparator 101/2 will remain permanently ON, and the warning loop thus remains self-holding.

The self-holding feature and the block PW can be defeated by including in the feedback loop, that is, in the circuit from the NAND-gate 112/1 to the transistor 120 corresponding to stage 12 of FIG. 3, a selection gate 112/4 to disable the self-holding circuit and the block PW by means of the selection switch PW, resulting in mere output from the output block W. opt.

A warning signal which appears at the terminal 115 is suppressed by a subsequent malfunction signal—as will be explained below. The output of the NAND-gate 105/3, a logic 0, blocks the malfunction path (including comparator 101/1) by feedback to NAND-gate 105/1 and through AND-gate 107/2. AND-gate 107/2 is part of the malfunction part or circuit. The priority, thus, is that warning in the central station has priority over a malfunction signal, although a subsequent malfunction signal will override the warning signal.

Resetting of the warning signal path is done in customary manner, by operating a reset switch and applying suitable voltages to the respective gates and driver circuits. Coupling resistors, noise and stray pulse suppression circuits 141' including diodes, resistors, and the like, are not shown in detail since they can be included in the circuitry in accordance with any well known and standard circuit design. Transistor 121 is temporarily blocked by the output of coupling amplifier 101/4, in order to remove supply voltage from the line S1, terminal 115. This causes collapse of the signal at the output of the comparator 101/2 so that this signal will drop to 0 V, permitting resetting of the timing stage 108 over the inverter gate 103/3 and NAND-gate 105/2.

After a delay of about 1 second, gate 105/3 will be caused to block, for example by applying over an R/C circuit a blocking voltage, to permit resetting of the entire warning signal path ready for a subsequent drop in signal voltage at line S1, if a gas concentration should be sensed by a sensing unit.

Alarm signal path (FIG. 8): Under ordinary operating conditions, that is, neither alarm nor malfunction, input terminal 116, connected to line S2, is connected with −22 V supply. Connection is over transistor 122 and resistor 199 and operational amplifier 102/4. The terminal 116 is further connected over the alarm line with a resistor of 4.7 kOhm to the reference terminal 0 V.

Like the warning line, a group of comparators in the form of operational amplifiers, for example of the type MLM 324, is provided. Two operational amplifiers 102/1 and 102/2, corresponding to stage 30 (FIG. 3) have their respective inverting inputs connected through a resistor to the terminal 116. The comparison voltage supply, connected to the direct input, can be by a voltage divider, not shown; the connection can be similar to that described with relation to FIG. 7. Only the voltage levels at the respective comparators are shown, so that the input voltages at the direct inputs of the comparators will be as follows: 102/1: −3.4 V; 102/2: −20 V. Comparator 102/3 is a current detector. Its reference voltage at the inverting input is −21.5 V. The quiescent current, determined by the termination resistance of 4.7 kOhms, the resistor 104, the base current of the transistor 122 and the resistor 172, is sufficient to hold the comparator 102/3 in conductive state, so that its output will be at 0 V level.

Under normal operating conditions, the output voltages of the comparators 102/1 and 102/2 alao are 0 V, since the voltage at the input terminal 116 is 21.5 V.

Let it be assumed that a sensing unit provides an alarm output signal. The input voltage at line S2, terminal 116, will drop to −10 V. The output of comparator 102/2 thus will have a voltage of −22 V appear thereat, that is, a logic 0. This voltage is applied, with some time delay—through delay circuit 141—to inverter 104/2 which, functionally, is the equivalent of inverter 103/3, FIG. 7. The output of inverter 104/2 then will be a logic 1, which is applied to one input of NAND-gate 106/2.

The output from comparator 102/1 is applied through a time delay circuit 140, through an inverter 104/1 to a NAND-gate 106/1, and then to the second input of NAND-gate 106/2. The NAND-gates may, for example, be of the type MC 14011. The comparator 102/1 has not yet been triggered, so that the second input to the NAND-gate 106/2 will be a logic 1, so that the output of NAND-gate 106/2 will be a logic 0. This output signal activates a self-holding loop circuit, as well known, using NAND-gates 106/3, 106/4. The output of the NAND-gate 106/4, a logic 0, blocks the malfunction path (including comparator 102/1) by feedback to NAND-gate 106/1 and through the AND-gate 107/2. AND-gate 107/2 is part of the malfunction path or circuit. Blocking of the malfunction path is done in order to insure that alarm signals will have priority over malfunction signals. The output from NAND-gate 106/4 is applied over inverter 104/6 to an input of an AND-gate 110/3 and from there over a driver amplifier, for example of the type MC 14011, to an acoustic alarm output terminal Al.acu. corresponding to the line **31*b* (FIG. 3**). An LED indicator may likewise be activated, through a suitable driver circuit.

Various other alarm circuits can be triggered from the output of the inverter 104/6, such as an acoustic alarm bell directly connected to the central station, over suitable drivers, connection of relays which provide indication of alarm, or multiple-winding relays which are respectively connected to the output from the warning system circuit, the alarm system circuit, and the malfunction system circuit to provide an overall caution, warning, etc. signal and the like. Optical indications can also be provided, in addition to the LED display.

To distinguish between warning signals and alarm signals on indicators associated with the sensors themselves, a flashing interrupter can be activated. The flashing interruptor, for example, is formed of a combination of Schmitt trigger circuits, for example the combination of an inverter 103/5, and a resistor and capacitor network 132, the output of which is connected through an amplifier to control a transistor 123 which, in turn, is connected to control the current in the operational amplifier 102/4. The operational amplifier 102/4, in combination with transistor 122 periodically switches its output current between 10 mA and 80 mA.

When the central station is in operation, when it is not under "test" mode, the output from the AND-gate 110/3 can also be used to cause additional control and warning functions. The output from the AND-gate 110/3 thus can be used to trigger all remedial control units, such as fans, ventilators, and the like, entirely independently if the warning signal path has already been activated, that is, independently of the time delay occasioned by the timing stage 108 in the warning path. Preferably, buffer circuit is interposed between the output from the AND-gate 110/3 and additional control units, to which, also, the output of the warning signal path is connected, so that one avoids that, upon quick termination of the acoustic warning signal upon delayed warning, a new alarm will be initiated.

The reset switch RESET (see also FIG. 7) is also connected into the alarm circuit, and there shown again for purposes of clarity. The comparator 101/4 has its output connected to the collector of transistor 123, and hence to the current generator 102/4, so that the current generator 102/4 will be turned "off". The alarm stage 106/4 is reset, after a time delay determined by an R/C circuit, for example after about 1 second time delay. This resets the entire alarm signal path to normal operating condition.

The system is connected together to provide, in addition to the alarm signals which can be provided from the respective sensing units, a malfunction signal, that is, if anyone of the lines are interrupted or short-circuited. Malfunction of this type is also indicated by the central station.

The malfunction path (FIG. 9) utilizes the comparators 101/1, 101/3 (FIG. 7), and 102/1 and 102/3 (FIG. 8).

If either the warning or alarm line S1 or S2 is interrupted, then the voltage at terminals 15 or 16, respectively, or both, will rise to such an extent that the comparators 101/3 or 102/3 respond.

Upon short circuit between the lines, or upon signaling of malfunction of one of the sensing units on the warning line, the voltage at terminals 15 or 16 will drop below 7.5 V. Consequently, comparators 101/1 or 102/1 will respond. Additionally, and undesirably, the comparators 101/2 and 102/2 may also respond, since their threshold levels are still higher. In order to prevent an undesired false indication of a warning or alarm condition, the outputs of the comparators 101/2 and 102/2 must be separated from the warning and alarm circuits under those conditions. In the warning system—FIG. 7—this is done by the NAND-gate 105/1. In the alarm stage—FIG. 8—this is done by the NAND-gate 106/1. If one of the comparators 101/1 or 102/1 responds under malfunction conditions, then the respective output voltage becomes a logic 0, that is, −22 V. Consequently, the inverter 103/2 (FIG. 7) and 104/1 (FIG. 8) is enabled and from there logic circuits including the NAND-gate 105/1, 106/1 will control the NAND-gate 105/2 and 106/2 to block signals derived from the comparator 101/2 or 102/2, respectively. A time delay can be introduced into the logic circuit connection from the respective NAND-gate 106/1 to 106/2, or from 105/1 to 105/2, as desired.

The comparator outputs of the malfunction comparators 101/1 and 102/1, 101/3, 102/3 are applied over respective diodes to a common malfunction bus and applied over time delay circuits 130 to a Schmitt trigger formed by inverter 103/1 which, for example, may be an IC of the type CD 40106. If malfunction occurs, the voltage at the output of the comparators will be −22 V, that is, a logic 0. This results in an output of a logic 1 from the Schmitt trigger 103/1.

The output signal from the Schmitt trigger 103/1 is applied to a logic circuit formed of a group of logic gates having inputs as follows: A signal from the test switch and the reset switch; a signal from gate 106/4 (FIG. 8) and a signal from gate 105/3 (FIG. 7). The signal from the inverter gate 103/1 can pass through the logic circuit L1 if, and only if, the following conditions pertain:

test button switch not operated
reset switch not operated
no alarm signal from gate 106/4
no warning signal from gate 105/3.

The foregoing insures priority of warning or alarm over a malfunction signal.

Under normal operation, these conditions are met, and the output from the logic circuit L1 will then be applied to an LED display 109/2, corresponding to a malfunction indicator F, FIG. 3. The LED display, preferably, is connected via a driver. Additionally, the malfunction signal can be used for connection to the OR-gate 115/4 (FIG. 7), and to other warning and indication elements forming part of the system, such as optical indicators, remote indicators, buzzers, bells, or the like. Further, a relay which commonly controls indicators can be used, for example connected just in advance of the LED 109/2, to provide an overall malfunction operating signal. The relay can be self-holding or connected in a self-holding circuit in the system as a whole until reset, that is, until the malfunction has been cleared or, in case of a duct fire, the respective connecting lines have been repaired.

Reset can be done as well known, by interrupting a self-holding circuit and/or controlling the logic L1 so that the logic conditions resulting in an output signal will no longer pertain, for example, by operating the "reset" switch (e.g. to closed).

Additional circuits: used in the central station for checking of proper operability of the station itself as well as of the sensing units. The additional circuits are a test circuit and a supply and monitoring circuit.

The test circuit is used for periodic checking of the operability of the gas sensing units as well as of the central station, without activating any acoustic alarm, or causing any control or remedial outputs to occur, that is, upon operating a test switch, only an optical indication is to be obtained. Of course, ventilators and the like will then not be connected because this function is separate from the function of the central station itself. The central station resets automatically after a sensing unit has been activated. Activation of a sensing unit can be done, for example, by having a test operator apply a test gas to the sensing unit. Since the test operator will not be at the central station, the central station will rest automatically, if it was in the test mode and a signal had been properly sensed. For testing of the system, the "TEST" switch (FIGS. 7, 8, 9) is closed, so that a voltage of −22 V (logic 0) is applied to the AND-gates 112/1, 112/2, 112/3 (FIG. 7), 110/3 and 110/4 (FIG. 8) as well as to NAND-gate 105/4 (FIG. 7). A logic 0 at the inputs to the respective AND-gates blocks these AND-gates, so that the relay outputs and the acoustic signalization is blocked. The application of a logic 0 to the NAND-gate 105/4 (FIG. 7) causes switching of the timing of the timing stage 108 to the minimum time; simultaneously, the NAND-gate 112/1 disables self-holding of the warning signal. The flasher for the alarm is connected over a separate gate 110/4 connected to the "TEST" switch and not, as under normal operation, as described above.

A logic circuit L2 (FIG. 8) derives an input from the warning signal path and the alarm signal path, and insures that, to activate the blinker or flasher, both signals, "warning" and "alarm", that is, respectively S1 and S2, are present simultaneously. The logic circuit may, in its simplest form, be an AND-gate. The test operator thus can assure himself that the warning signal path operates properly which, otherwise, may not be possible due to a missing termination signal from the central station to the sensing unit.

Automatic reset of the central station upon an alarm is done by means of Schmitt trigger which includes a delay of, for example, about 10 seconds before the Schmitt trigger changes state to reset the circuits of the central station to quiescent condition after an alarm has been sensed and with the "test" switch closed. The Schmitt trigger can be enabled upon first sensing an alarm condition, for example by an output from the logic circuit L2 which, then, introduces the time delay to permit the respective circuits to provide their respective output indications so that the proper operability of the sensing unit, the connecting lines, and of the central station can be checked. The reset, then, is effected after the time delay determined by the trigger circuit has elapsed. The time delay circuit preferably includes a group of diodes which insure that only the desired flank of the signal arising upon closing of the circuit and/or upon generation of the alarm signal will trigger the time delay.

The power supply for the central station is, as customary, combined with a voltage limiter of −27 V, which is effected by a customary and well known transistor circuit. If a secondary or storage battery is to be connected for power supply independently of network voltages, a voltage blocking circuit, including for example a Zener diode and a diode, is to be used, thus insuring that a storage battery will not discharge even if the network voltage should drop to 85% of nominal value, for example. Upon complete removal of network voltage, for example upon burn-out or short circuit of the power supply due to failure of insulation, for example, the full energy can be supplied from the storage battery. A relay is provided to then bridge the voltage blocking circuit. The circuitry can be similar, for example, to that used in battery charging systems customary in automotive vehicles. The charge state of the storage battery, likewise, can be similarly checked, by use of diodes and a comparator, for example.

The system, therefore, by use of logic circuits employing, in preferred form, known integrated circuit elements, provides a simple and reliable central station to monitor the operability of a gas sensing, fire alarm, or similar system; to monitor the operability of the respective sensing units as well as of the central station itself; and to provide output signals, respectively, indicating a preliminarily dangerous condition to warn an operator while, further, providing an alarm indication if the sensed condition is such that an alarm is warranted.

The system thus provides a reliable and fail-safe arrangement to sense potentially dangerous or hazardous conditions. A sensing unit which is highly suitable in connection with this system is described in U.S. application Ser. No. 128,529, CHRISTEN, BRÄNDLI, DURRER AND SAUERBREY, entitled "Gas Sensing Unit for Use in Environment Comprising Explosive Gases", filed Mar. 10, 1980, and assigned to the assignee of the present application. The sensing unit described in this application is of a construction which is particularly adapted for location in an explosive or hazardous environment, with a housing which has at least two separate chambers, one of which is compression-proof; electronic evaluation circuitry—is provided and contained in the compression-proof chamber, the other of the chambers being explosion-protected. The sensor has a cover for closing the explosion-protected chamber which is formed of a gas-pervious sintered metal to permit exchange of gas with the surrounding atmosphere. A third explosion-proof chamber or space can be provided in the gas sensing unit to provide termination to connecting lines or conductors. The gas sensor, together with a balancing adaptor, forms an assembly or unit which can be arranged in the cover of the chambers in plug-in connection. Thus, the gas sensor can be readily assembled or exchanged for other gas sensors at the erection site without requiring opening of the compression-proof chamber which contains the electronic components. The testing and balancing of the gas sensor can be done at manufacture and, during operation, by checking the operability of the sensing unit at the central station upon operation of the TEST switch. Electrically, the equivalent circuit of the sensing unit is essentially as shown, for example, in FIG. 2 and FIGS. 5*a*, 5*b*, 5*c*.

The current level detection stage 4, the signal processing stages 5, 6 and 7 of FIG. 2, can be simply instrumented. Current level can be detected by placing a resistor in series with the line U, and sensing the voltage drop of the resistor, for example by connecting the base-emitter path of a transistor thereacross; if the current should rise above a predetemined level, and depending on the circuitry, and the number of stages involved, a transistor can become highly conductive, or block, and thus provide an output signal; conversely, upon drop of the current flow through the resistor, the voltage thereacross will change, thus again providing an output signal which causes blocking, or conduction, respectively, of a connected transistor, and again providing an output signal indicative of current flow. These signals can, then, also be connected to a visual indicator, thus providing a blinking indication if the current flow to the respective circuit varies between "high" and "low" levels.

The signal processing stages 5, 6, 7 receive the respective signals 2*a*, 3*a* and include self-holding and interlock circuits to prevent mutual interference and feedback; for example, if an intermittent or pulse current flow is applied to the cable U, S1, S2, O, other sensing units not affected by gases and thus not providing a sensing output function may have pulsing signals applied thereto. Thus, the respective processing stages preferably include integrating networks to insure that interlock circuits in those sensing units which have not responded will receive energy at essentially uniform level, and not in pulse mode. A capacitor/diode circuit is suitable.

The respective threshold sensing circuits ($T_1$, $T_2$, FIG. 5) change over if the output signal from a specific sensing element indicates the presence of gas. Upon such change-over, the voltage on the respective alarm line will be lowered by connection of a resistor therein. The central station C (FIG. 3) detects this change of voltage, as above described. The signal processing stages additionally include a monitoring circuit which monitors the voltage conditions of the respective lines S1, S2 independently of sensing function of the respective sensing unit. If the voltage level on one of those lines should change substantially—indicating that another sensing unit has responded by sensing a gas to be monitored—the respective voltage-sensitive transistor will provide a blocking signal to the comparator or other suitable circuit element within its own sensing unit to disable the sensing functions thereof so that only one sensing unit of a group will provide a sensing output indication—thus indicating to supervisory personnel which one of the sensing units of the group has first responded. Suitable buffer and interlock circuits can be provided, as determined by the individual sensing unit construction, and the network configuration.

Gas sensing unit and sensing unit signal paths: Sensors which are preferred for use in the present system operate in accordance with the principle of a change in electrical conductivity. Semiconductor sensors are particularly desirable due to their long-time stability, long life, and high sensitivity. Additionally, they have high resistance with respect to substances which poison catalysts. Changes in sensitivity by ambient climatic factors, such as temperature or ambient humidity, can be compensated by electronic circuitry.

The sensing units signal the presence of gases in two stages. The first stage responds at low concentration to provide a warning, and the second stage responds to a high concentration. The sensing unit contains a response indicator which, when a warning stage is sensed, provides an illuminated output. Upon sensing a concentration at the alarm level, the output becomes intermittent or flashing. This arrangement permits easy localization of a danger zone and permits simple checking of the function of the sensing unit by exposing the sensing unit to a test gas, for example from a test gas source or bottle and checking the response, similar to the way fire and smoke detectors are tested.

The sensing unit are connected over the four-line connecting cable. In a preferred form, no more than ten sensor units are connected in parallel over a single cable line.

Response of more than one sensing unit within a group, at the same level of priority, that is, the warning stage or the alarm stage, is prevented by the electronic system. Thus, a reliable indication of leakage of gases, and the position and concentration of the leakage, can be readily obtained. For use in explosive surroundings, the sensing unit structure of the aforementioned copending application U.S. Ser. No. 128,529, CHRISTEN et al, is recommended.

Basically, the sensing unit has these components: A semiconductor sensing element, a detection circuitry, and signal processing circuitry, for transmission to the evaluation or analysis circuitry of the central station. The structure is preferably so arranged that the detection element itself, the signal processing stages, and connection terminal plates are placed on separate circuit boards, such as printed circuit boards, all contained within housings which are inaccessible to unauthorized personnel. A sensitivity switch can be enclosed within the housing, inaccessible to unauthorized personnel. The various circuits can be calibrated or set, and checked at the point of manufacture. In addition to the sensing unit outputs, relay terminals for connection to external alarm or further indicators may be provided.

Referring, first, to FIGS. 10 and 11. The sensing unit has the following terminals: A line 1092, corresponding to the line U (FIG. 1) and normally at the level of −27 V. A line 1041, normally at reference voltage, i.e. 0 V, and corresponding to line O (FIG. 1). Two additional lines, line S1, corresponding to terminal 115 (FIG. 7) at a normal level of −22 V, and the alarm signal line S2, terminal 116 (FIG. 8) at a normal level of about −21.5. Internally, another important terminal is provided: Terminal 1321, which provides a control terminal to monitor the function of the sensor itself. For use within the sensing unit, a stabilized voltage is obtained at an internal stabilized voltage terminal 1211.

The sensing printing circuit board—to be described—can be used independently as a functional unit and, if analog output is required, can be used as such in other systems as well; likewise, other types of sensors providing an analog output can be used, with the signal processing stage converting the analog output to the signal level outputs which are compatible with those which can be analyzed or evaluated by the central station.

Terminal 1092, FIG. 10, is connected to a stabilized voltage circuit through a resistor network formed of resistors 1058, 1059, serially connected. The tap point of the resistors is connected to the base of a transistor 1011, as will appear further below. The stabilized voltage circuit has a reference voltage applied thereto, supplied by a Zener diode, for example of 10 V breakdown voltage, and a resistor 1046. The stabilized voltage circuit can be in accordance with any well known standard construction.

The output of the stabilized voltage circuit is available at a terminal 1211. The value of the stabilized voltage, that is, its level, can be controlled, as well known, for example by setting of an internal resistance network. The stabilized output voltage is used as a supply energy for the sensor measuring circuit, and to supply stabilized voltage to the logic circuit which includes the warning alarm and monitoring signal paths.

Depending on the type of gas sensor, a heater voltage is required therefor. The usual heater voltage is 5 V and is high frequency A/C, for example at about 40 kHz. The heater power is generated in a heater circuit which, typically, is an CMOS integrated circuit of the type RCA CD4047. The output is stabilized by applying a stabilized voltage to the CD4047 in addition to supply energy. Depending on the type of sensor, a measuring circuit voltage of between 2.5 and 5 V is provided, controlled, for example, by a transistor 1010, in series with the measuring circuit, and a calibration resistor 1033, connecting the measuring circuit to the ground or reference bus 1041, which corresponds to bus U, FIG. 1. The transistor has a suitable base voltage applied thereto derived, for example, from a voltage divider connected to the stabilized voltage terminal 1211, and can include tapped resistors to match the supply voltage to the sensor element 1002 to the required value therefor. Various types of sensor elements are suitable; typical elements are the type TGS 812 or TGS 813 of the company Figaro. The calibration resistor 1033 can be used to accurately calibrate the units so that variations in response and sensitivity of individual sensor elements 1002 can be compensated and to provide reproducible and uniform output characteristics from all sensors of one type.

The output signal from the sensor is applied to a smoothing network which includes the R/C network 1043, 1030, and is then connected to the direct input of an operational amplifier 1005/2. The operational amplifier raises the output from the sensor 1002 to the requisite level for use in the system. Additionally, a compensation, at least partially, for atmospheric humidity and temperature can be obtained by the temperature and humidity compensation network 1061, shown only schematically and which, by and itself, is a well known arrangement. This network is included in the feedback path of the operational amplifier 1005/2. The operational amplifier 1005/2 is, preferably, physically combined as an integrated circuit element with another operational amplifier 1005/1. Direct current supply can be obtained by rectification of the controlled output for the heater supply of the sensor 1002.

The output signal from the sensor is available at terminal 1031. Coupling resistors and elements have been omitted from the diagram for clarity, and can be included as well known in electronic circuitry.

The output signal from the sensor is an analog of gas concentration, i.e. varies with increasing concentration of the gas to which it responds.

Semiconductor sensors, like the sensor 1002 referred to, have a start-up time. In order to accomodate the start-up time, and to prevent false alarms, it is necessary that the sensor output signal at terminal 1031 be suppressed for about 2 minutes after the system is placed in operation, that is, the sensor 1002 is energized. This is accomplished by the operational amplifier 1005/1, connected as an integrator.

Upon connection of supply voltage, the output of the integrator stage, using the operational amplifier 1005/1, and connected to the inverting input of operational amplifier 1005/2 through a diode 1019, causes the operational amplifier 1005/2 to become supersaturated, that is, blocked, so that its output voltage will be at a +5 V level. As the output voltage of operational amplifier 1005/1 drops slowly to 0 volt, the operational amplifier 1005/2 will be able to achieve its function as an amplifier and thereafter the sensor output signal will be available at terminal 1031.

Charge current for the capacitor 1026 in the feedback path of the operational amplifier 1005/1 is obtained through the resistor 1035 which is connected in parallel to a diode-resistor network which functions as a capacitor discharge circuit. The capacity of capacitor 1026 is high, for example 68 μF, and the discharge time can be so dimensioned by suitable choice of the resistor 1050 in series with diode 1018 that it will be in the order of only about 2 seconds. Short-time interruptions of the supply voltage, thus, will not cause discharge of the capacitor and interruption of the system, but long-time interruptions will not cause a dangerous charge condition to persist.

A self-monitoring circuit for the sensor is provided by the transistor 1011, connected to the junction of resistors 1058 and 1059. The transistor 1011, the connection of which is shown only schematically and omitting supply circuit components, is connected through an inverter 1012 and a coupling resistor 1036 to a monitor terminal 1321. Short-time malfunctions or interruptions, for example due to stray voltage peaks or the like, are suppressed by the resistor capacitor network formed by the resistor 1036 and capacitor 1025. In ordinary operation, that is, "no malfunction," the voltage at terminal 1321 has a level which corresponds to that of the supply voltage, that is, −27 V. In case of malfunction or defects, the voltage will change to 0 V.

The circuitry so far described can all be included on a sensor printed circuit and sensor holding arrangement or terminal plate, and can be independently used.

The logical evaluation of the output signals derived from the sensor, stages 2, 3 and 6 and 7 (FIG. 2) is obtained by connecting the signal at terminal 1031 to the logic circuit to be described which may, for example, be applied to a separate printed circuit board.

The output of the sensor, terminal 1031, is evaluated independently by comparators 1001/3 and 1001/1 (FIG. 11), in which the comparator 1001/3 is utilized to control the warning signal path, and will be described first. If the output level of the sensor reaches a first and lower value, the comparator 1001/3 will respond.

Warning level signal path (FIG. 10):

The reference level of the comparator 1001/3, coupled to terminal 1031 over coupling resistor 1072 and applied to the direct input thereof, is determined by a resistor network connected to the stabilized voltage terminal 1211, and including resistors 11061, 1062, 1076, 1088, and a sensitivity selector switch 1127. If the sensor output signal, terminal 1031, reaches the threshold level determined by the resistor network, and as set by the sensitivity level switch 1127, the comparator 1001/3 will respond and will control transistor 1008 to become conductive by applying an output through coupling resistor 1078. The response hysteresis of the operational amplifier 1001/3 is determined by the respective resistance values of resistors 1072 and 1050 which, for the examples selected, may for example be 100 kohm and 10 meg ohm, respectively.

Under normal operating conditions, the voltage at terminal 115 (FIG. 7), that is, on line S1, is −19.45 V. This voltage is determined by a resistor network in the central station, as well as by the resistance of a diode 1028 and a resistor 1089, in series therewith, and then will drop to about 19.45 V. If the transistor 1008 is rendered conductive, that is, when operational amplifier 1001/3 responds, the voltage at the line S1, terminal 115, wil change from −19.5 V to about 10 V, due to resistor 1089 and diode 1028. Simultaneously, diode 1030, connected to the collector of the transistor 1008, will cause the operational amplifier 1001/4 to respond. The output of the operational amplifier 1001/4, connected as a comparator, is connected to a diode 1033*a*, and then to an indicator lamp and driver circuit combination, shown schematically merely as a lamp 1023. The driver circuit may be an additional power limited lamp driver including transistors, a Zener diode, and the like, to provide a voltage and current limited output to energize a visual indicator.

The comparator 1001/4 has a hysteresis network 1055, 1056, and an output resistor 1079 connected to the direct input thereof, and and is so connected that the warning indicator signal remains applied to the lamp driver circuit so long as the signal on line S1 or at 10 V, regardless of whether this 10 V signal is caused by conduction of the transistor 1008 or due to the dropping of the voltage on the line under control of the central station, as explained in connection therewith, to provide self-holding function. Thus, the holding of the indicator is determined from the central station; of course, a self-holding circuit can be included in any event in the indicator requiring, however, resetting thereof upon termination of a warning stage.

Operation: Normal condition, no warning: The inverting input of comparator 1001/4 has a voltage of about 17.5 V thereon, determined by a reference Zener diode 1016, resistors 1053, 1054, and the line voltage of 19.5 V on line S1, terminal 115. The direct input has a voltage of about 10 V, provided by the comparator output of 0 V thereof, and feedback to line 51, through the resistor 1056, as well as the resistor 1055. Since the comparator output is 0 V, no signal output, of course, will result.

Warning condition: The line voltage, terminal 115, S1, will be about 10 V, and transistor 1008 is conductive. A voltage is applied over diode 1030 to the inverting input of comparator 1001/4 which will be about 0 V. The output from comparator 1001/4 thus will have fully supply voltage at the output terminal and subsequent signal indications and circuits will be activated.

The voltage divider 1055/1056 would cause a voltage at the direct input of the comparator 1001/4 of more than 15 V, determined by the line voltage of S1 at terminal 115 and the supply voltage at the output of the operational amplifier. Diodes 1022 and 1016 insure that the voltage at the direct input cannot exceed 15 V, and the comparator will remain activated. Simultaneously, the input at the inverting trerminal can always be reset.

Termination of warning signal: Transistor 1008 will not be controlled to conduction, and line voltage will revert to normal 19.45 V, unless the central station retains the line voltage at 10 V, that is, warning with self-holding, as determined by the mode of operation of the central station, that is, with or without self-holding, in accordance with switch setting therein. The voltage at the inverting input of the comparator 1001/4 is then again determined by the voltage divider 1053, 1054, and the Zener voltage of Zener diode 1016, as well as the voltage at terminal 115.

Upon release of self-holding, the line voltage at terminal 115 will rise to −19.45 V, which will cause a similar rise at the inverting input of the comparator 1001/4 to 17.5 V, and the comparator will revert to quiescent state, its output terminal having 0 V.

If the line voltage at terminal 115 is clamped by the central station to −10 V, then the voltage at the inverting input of the operational amplifier 1001/4 can reach only −12.5 V, since the line voltage is 10 V and the Zener voltage is −14.5 V, and further supplied over the voltage divider 1053, 1054. The direct input still will have the voltage of −15 V appear thereat, so that comparator 1001/4 will retain its activated state.

Capacitor 1044, and other similar capacitors prevent short-time voltage peaks or noise signals to interfere with the operation of the comparator 1001/4.

Priority indication of output: The first sensing unit which responds to a higher gas concentration condition will provide an output signal; a circuit is provided to block other sensing units from providing outputs thereafter to trigger a warning signal at the central station. Comparator 1001/2 is used for this purpose.

In ordinary condition, the inverting input of comparator 1001/2 has a voltage of −19.45 V applied thereto. Since the input voltage at the direct input is always at 14.5 V, due to the connection of the Zener diode 1016 the output voltage of the comparator 1001/2, normally, is 0 V.

Let it be assumed that another sensing unit of the same group, that is, the same connecting line, signals a warning signal. The voltage at terminal 115, line S1, thus will have dropped to 10 V. This voltage is applied over resistor 1051 to the inverting input of the comparator 1001/2. The voltage at the direct input, due to the presence of Zener diode 1016, is 14.5 V, and the comparators switch over and block the comparator 1001/3 over diode 1026 and the R/C time delay network 1073, 1046*a*. Additionally, the output is connected over a diode 1024 which insures that a possibly later-occurring malfunction signal at terminal 1321 is suppressed.

A coupling resistor 1059 prevents mutual interference between the voltage divider 1059*a*, 11061, 1062, 1076, 1088 connected to the comparator 1001/3 and the blocking signal path through the diode 11026 and the R/C network 1073, 1046*a*.

Let it be assumed, then, that the sensing unit itself provides a warning output signal. A circuit is provided to prevent self-blocking of the sensing unit by its own comparator 1001/2. In order to prevent such self-blocking, the voltage appearing at the output of the comparator 1001/4 is supplied as supply voltage to the inverting input of comparator 1001/2 over the diode 1032 as a blocking signal.

Resistor 1051 prevents mutual interference of voltages between terminals 115, line S1, and the inverting input of the operational amplifier 1001/2. Before the blocking signal at the inverting terminal thereof can be effective, the voltage at the inverting terminal will drop to 10 V due to the instantaneous dropping of the voltage at the line S1, terminal 115, so that the comparator will switch through. The output signal thereof, however, is delayed by the R/C network 1073/1046*a* for such a period of time that the blocking signal at the inverting input can become effective, so that the blocking path between the output of the comparator 1001/2 and the inverting input of the comparator 1001/3 will become ineffective.

Various dropping, bleeder and coupling resistors, and stray peak, noise, and interference pulse suppression resistors and capacitors have been omitted; it is recommended to include an R/C network in order to suppress short-time voltage peaks and high-frequency interference which may occur or be picked up on the lines S1, U, O, and also S2, and such other lines as may be used.

Alarm signal path, with reference to FIG. 11: The alarm signal path is connected to the terminals of the sensing unit portion, reproduced on FIG. 11. The left side of FIG. 11, thus, will be identical to that of FIG. 10. The two circuits of the warning signal path of FIG. 10 and the alarm signal path will be connected side-by-side, i.e in parallel.

The output signal from the sensor, terminal 1031, is connected through a coupling resistor 1076 to an R/C delay circuit 1064/1038. The reference voltage applied to the inverting input of a comparator-connected operational amplifier 1001/1 is derived from the same voltage divider used with comparator 1001/3, that is, through the resistors 11061, 1062, 1076, 1008, forming a voltage divider, in combination with the sensitivity selector switch 1221, and connected to the source of stabilized voltage 1211. The tap point for connection to the inverting input is connected through a coupling resistor 1058*a* to provide a different voltage level to the comparator 1001/1 than to the comparator 1001/3.

If the voltage supplied to the inverting input and to the direct input have a predetermined relationship, the comparator 1001/1 will change state. The output signal is fed back over a resistor-diode series circuit 1084, 1021 to provide for self-holding of comparator 1001/1.

The output signal of the comparator 1001/1 is connected over a diode 1034 to the indicator lamp and driver circuit 1023, described above. The diodes 1033 and 1034, thus, function effectively as an OR-gate. The output signal is additionally applied over a current-limiting resistor 1086 to a switching stage which includes a transistor 1009 and a diode 1031, connected to the collector thereof, as well as a Zener diode 1019 in series with a resistor 1090, connected to ground potential, and both serially connected to the emitter of transistor 1009. When the comparator 1001/1 changes state, transistor 1009 will become conductive, causing the voltage at the alarm line S2, terminal 116 (FIG. 8), to drop from the normal voltage of −21,5 V to −4.5 V. The cental station detects this substantial change in voltage, provides an alarm output, and additionally connects the intermittent or flashing circuit to provide an intermittent current from the intermittent current supply of the central station—see description in connection therewith, and with reference to FIG. 8. An intermittent voltage will arise across resistor 1090 which periodically renders the transistor 1011 conductive and non-conductive. The signal across the diode 1034 thus is perodically suppressed, causing the indicator lamp, connected to its driver circuit and forming the combination 1023, to flash periodically in the rhythm of the intermittent current supplied by the central station.

The transistor 11010, having its base connected through coupling resistor 1065 to the output of the comparator 1001/1 insures that only one sensing unit of the group can cause an alarm. This is accomplished by connection to an integrating circuit connected to the alarm line S2, terminal 116 (FIG. 8).

When the alarm line S2 is in normal state, that is, no alarm being supplied by any sensing unit, the voltage at the terminal 116 is about −21.5 V. A voltage divider formed of resistors 1048, 1049, and other resistors connected thereto, if desired, causes a voltage to be applied to the base of transistor 1010 to render the transistor conductive, so that is collector will have a voltage of about 0 V. If the voltage at the alarm line S2 drops, transistor 1010 will block, causing its collector to have essentially supply voltage due to the collector resistor 1083 between the collector and the line U. Diode 1025 causes blocking of the comparator 1001/1. Resistor 1058*a* in the connection to the inverting input of comparator 1001/1 prevents mutual interference between the voltage divider 1061, 1062, 1076, 1088, and the blocking path through diode 1025. Diode 1017 suppresses a possibly occurring malfunction signal at terminal 1321.

The integrating signal in advance of transistor 11010 is necessary because of the blinking function under alarm conditions.

To obtain blinking, intermittent current is supplied over the alarm line S2 to the sensing unit which caused the alarm. Since the sensing unit, in addition to the logic network, for general network reasons, has protective resistors in series with the respective lines, to prevent damage to the sensing units due to excessive currents, for example upon erroneous connection, periodic voltage variations will be caused on the alarm line of the sensing unit, which are superposed or modulated on the already lowered alarm line voltage. Sensing units, which did not cause an alarm, thus, may be affected and, to prevent this, an integrating circuit is provided in all the sensing units, which insures that the blocking function of the transistor 1010 is retained even though there are modulated voltage variations. The resistor-diode-capacitor network 1096, 1035, 1045 insures this integration. Capacitor 1045 has a high value, for example 10 μF, the resistor 1096 determining the charge condition for the capacitor;diode 1035, the discharge of the capacitor in such a manner that the average value of the voltage over capacitor 1045 is as low as possible, such that transistor 11010 is not becoming conductive.

The sensing unit, of course, should not block itself if it provides an alarm. Transistor 11010 then is controlled over resistor 1065 from the output of the comparator 1001/1, causing the collector output voltage of transistor 11010 to remain, as in normal conditions, at 0 V, and thus preventing activation of the blocking path over diode 1025 and/or 1023.

The alarm signal path is reset by disconnecting the switch "RESET" in the central station. The comparator 1001/1 will change over to its normal state. One or more capacitors, and/or R/C networks prevent undesired response due to stray or noise pulses.

Monitoring signal path: The sensing unit is self-monitoring; any malfunction signal of the self-monitoring circuit is applied from the sensing unit portion over terminal 1321. Referring again to FIG. 10, the terminal 1321 is connected to a Schmitt trigger 1004, which can be of standard construction, for example an integrated circuit consisting of two cascaded transistors with a suitable resistor network. The 0 V output signal of the Schmitt trigger is applied over a diode 1029 to the input of the comparator 1001/4. Diode 1029 and diode 1030, thus, function as an OR-gate. Consequently, and due to control of the comparator 1001/4 by the diode 1029, upon response of the Schmitt trigger, the lamp and driver circuit combinations 1023 will be activated, causing a malfunction indication to be delivered by the indicator lamp element. Additionally, a field effect transistor (FET) 1003 is controlled to conduction over resistor 1052, coupled to a capacitor 1041*a* to provide a short time delay. Upon conduction of the FET 1003, warning line S1, terminal 115, will have a substantial voltage drop, that is, for all practical purposes, the line will be short-circuited through the FET, so that the voltage at the line S1 with respect to the line O will collapse and become about 0 V. The resistor 1052 provides a limit for the leakage current from the FET 1003. Capacitor 1041 additionally suppresses stray noise voltages. Similar to the operation of the warning circuit alone, comparator 1001/2 insures that only one sensing unit connected to a line S1 can trigger a malfunction signal. Should another sensing unit of the same group also signal a malfunction signal, the voltage at the inverting input of the comparator 1001/2 will drop to 0 V, so that that comparator will switch over and cause the same blocking function as in the warning mode.

If the same sensing unit signals malfunction, the diode 1032 insures that the sensing unit will not block itself over comparator 1001/2 and diode 1024.

Various circuit components and standard in the electronic engineering field, such as protective resistors, reverse-polarity protection diodes, and the like, have been omitted from the diagrams, since their connection and use is well known.

We claim:

1. Gas sensing system having a plurality of gas sensing units ($G_1 \ldots G_n$), each sensing unit including a gas sensor (1) providing a sensing output signal (1', 1*a*, 1*b*) upon sensing presence of a gas to which the gas sensor is responsive;

threshold level means (2,3) responsive to said sensing output signal having at least two threshold levels (low, high) and providing respective low level and high level output signals (2*a*, 3*a*) upon sensing gas concentration exceeding a lower level, or exceeding a higher level, respectively;

a low level signal processing stage (6);

and a high level signal processing stage (7), said signal processing stages being respectively connected to said threshold level means and responsive to the respective low level and high level output signals (2*a*, 3*a*);

a central station (C);

connecting cable means (U, $S_1$, $S_2$, O) interconnecting the central station (C) and the gas sensing units ($G_1 \ldots G_n$) for signal transfer between said central station and said units, said central station (C) including a warning stage (W);

an alarm stage (A);

a low level input signal analyzing stage comprising a warning signal timing stage (11) establishing a warning signal time interval;

a warning signal input circuit (10) and warning signal transfer means responsive to the low level signal (2*a*) over said connecting cable means and activating said warning signal timing stage (11);

a warning signal self-holding circuit operative if the low level signal (2*a*) persists for the timing duration of said warning signal timing state (11) for then activating said warning stage (W);

and a high level signal analyzing stage comprising an alarm signal timing stage (31) establishing an alarm signal time interval which is shorter than the warning signal time interval;

an alarm signal input circuit (30) and alarm signal transfer means responsive to the high level signal (3*a*) over said connection cable means and activating said alarm signal timing stage (31);

and an alarm signal self-holding circuit operative if the high level signal (3*a*) persists for the timing duration of said alarm signal timing stage (31) for then activating said alarm stage (A).

2. System according to claim 1 wherein the alarm signal timing stage (31) has a time interval in the order of about not more than one-half minute.

3. System according to claim 1 wherein the warning signal timing stage (11) has a time interval in the order of about at least one-half minute.

4. System according to claim 3 wherein the alarm signal timing stage (31) has a time interval in the order of about not more than one-half minute.

5. System according to claim 1 including supply voltage circuits for said timing stages and for said gas sensing units, wherein said warning signal timing stage (11) and said alarm signal timing stage (31) and the respective supply voltage control circuits (12, 32) are included in networks located in the central station.

6. System according to claim 1 wherein said high level processing stage (7) is self-locking and said alarm signal timing stage (31) comprises counter and timer circuits, having an output (31*a*) when said high level signal (3*a*) is transferred thereto by said transfer means (7, 30), and an alarm signal supply voltage control circuit (32) is provided, connected to said output of said timing stage (31) and briefly interrupting the voltage on the corresponding signal line and thus releasing the self-locking feature of said high level processing stage (7) and then permitting renewed transfer of the high level signal (3*a*) thereto if it still persists, the alarm stage (A) being connected to the output of said counter circuit and activated upon sensing of a predetermined count number of said counter circuit corresponding to a predetermined number of interruptions for a predetermined time interval of said timer circuits.

7. System according to claim 6 wherein said alarm signal transfer means (30) and said alarm signal timing stage (31) transfers the high level signal to the alarm stage (A) for immediate generation of an alarm upon receipt of the high level signal (3*a*).

8. System according to claim 1 further including an indicator (8) and/or control unit (9), each connected with the respective gas sensing unit and providing a first type of indication and/or control output if the low level threshold circuit (2) provides a low level output signal, and a second type of indication and/or control output if the high level threshold circuit (3) provides a high level output signal.

9. System according to claim 8, including means for providing an output indication of presence of a low level output signal in form of a continuous indication, and means for providing an output indication of a high level output signal in form of an interrupted, or chopped indication.

10. System according to claim 8 wherein the low level output providing means representative of presence of a low level signal furnish an intermittent signal having a first repetition, or interruption frequency or characteristic, and the high level output providing means representative of the high level signal furnish an intermittant signal having a second repetition or interruption frequency or characteristic.

11. System according to claim 1 wherein the threshold level means (2, 3), are positioned in and form components of the respective gas sensing units ($G_1 \ldots G_n$) and commonly connected to the gas sensor (1) of the respective sensing unit.

12. System according to claim 11 wherein the respective threshold level means includes threshold adjustment circuits ($R_1$, $R_2$, $R_3$, ZD) permitting adjustment of the respective threshold levels of the individual sensing units.

13. System according to claim 12 wherein the adjustment elements comprise a voltage divider ($R_1$, $R_2$, $R_3$, ZD) having at least three voltage division components, of which at least one ($R_1$) is adjustable, and providing respectively different reference voltage levels;

and comparator means ($T_1$, $T_2$) are provided, connected to said gas sensor (1) and comparing the output of said gas sensor with the respective reference levels as provided by said voltage divider.

14. System according to claim 13 wherein the voltage divider comprises a Zener diode (ZD) to introduce nonlinearity of adjustment response to the voltage divider.

15. System according to claim 1 wherein the warning signal transfer means (6, 10) and the alarm signal transfer means (7, 30) comprise supply voltage control circuits (12, 32) connected to respective connection lines ($S_1$, $S_2$) forming part of said connecting cable means and further connected to respective low level and high level signal processing stages (6, 7) positioned in the sensing units ($G_1 \ldots G_n$);

said supply voltage control circuits being operative to reduce the operating voltage at the respective connecting line upon response by a respective threshold level means (2, 3).

16. System according to claim 15 wherein the voltage control circuits are operative to control reduction of the supply voltage control circuit (12, 32) by a predetermined amount, to a level of which transfer of an output signal from the respective low level signal processing stage of a sensing unit, after another sensing unit has already responded, is inhibited.

17. System according to claim 1 wherein the connection cable comprises a power supply connection line (U);

the respective gas sensing units ($G_1 \ldots G_n$) include a current sensing element (4) connected in circuit with the supply line of the gas sensor (1) and providing an output if the current flow through said supply line deviates from a predetermined level, said output being connected to a signal line on the cable for transfer to the central station (C);

and wherein the central station comprises means (20, 21) responsive to a signal on the respective connecting line indicative of malfunction upon detection of the current sensing element (4) of deviation of the current from the predetermined value, whereby malfunction within the sensing unit, or the connecting power supply line may be indicated.

18. System according to claim 17 wherein the malfunction detection means within the central station includes a supply voltage control circuit (22) dropping the supply voltage on the respective signal line to a level detectably different from the change in supply voltage upon response of the gas sensor (1) and generation of a threshold output signal **(2*a*, 3*a*)**, thus providing a self-holding signal on the sensing unit malfunction indicating stage F'.

19. System according to claim 1 wherein the plurality of gas sensing units are spacially distributed and connected to the cable along the length thereof;

and further including a termination element (E) connected to the cable beyond the connection point of the last gas sensing unit ($G_n$) of the system.

20. System according to claim 19 wherein the connection cable comprises a power supply bus (U,O) and at least two threshold level sensing signal lines ($S_1$, $S_2$);

and wherein the termination element is connected to at least two of the lines of the cable, and is capable of generating a response signal on one of the signal lines ($S_1$, $S_2$) indicative of proper operation of the cable.

21. System according to claim 19 wherein the termination element includes a controlled switch (SW) having its control connection connected to one of the signal lines ($S_1$, $S_2$), the switch being connected to maintain current flow through another one of the signal lines if the voltage level of said one signal line is above a predetermined minimum value, and to provide an open circuit, indicative of malfunction if the voltage level of said one signal line should fail, to permit response of the malfunction detection circuit (40) in the central station (C) upon departure of current flow within another one of the signal lines from a predetermined value to thereby indicate either an open circuit, or short circuit condition within the cable.

22. System according to claim 21 further including a malfunction indicating stage (F) associated with the central station (C) and providing an output indication upon response of the malfunction detection circuit (40) within the central station (C).

23. System according to claim 22 including means for suppressing a malfunction indication in the central station by a warning or an alarm indication.

24. System according to claim 22, including means for suppressing a warning indication in the central station by an alarm indication.

25. System according to claim 1, wherein the gas sensor (1) comprises a semiconductor sensing element having an electrical resistance which changes upon sensing gases to which the semiconductor is responsive.

26. System according to claim 1 wherein the gas sensor (1) operates on the catalytic oxidation principle using a balanced bridge circuit.

27. System according to claim 1 further including test circuit means (T) connected to override the timing stages (11, 21, 31) to permit testing of functional operability of a system without generation of self-holding warning indication, self-holding alarm indication or self-holding malfunction indication by the warning stage (W), the alarm stage (A), or the malfunction indicating stage (F).

28. System according to claim 1, wherein the warning signal input circuit and the alarm signal input circuit, respectively, include threshold sensing means providing an output signal if (a) the voltage of the respective level output signal is at a predetermined level, indicative of normal operation;

(b) the voltage of the respective level output signal is below said predetermined level by a predetermined value, indicative of response of a sensing unit;

(c) the voltage of the respective output level signal is above a predetermined level, indicative of interruption of the connecting cable means;

(d) the voltage of the respective level output signal is below said predetermined value indicative of short circuit of said connecting cable means.

29. System according to claim 28, wherein the threshold circuits are physically part of the central station and comprise comparator circuits.

30. System according to claim 28, wherein the central station includes voltage supply means providing a reference voltage at the predetermined level (−22 V);

and the threshold sensing means are connected to said reference voltage to provide said output signals as a function of the voltage of the respective level output signal applied thereto by said connecting cable means, with respect to said reference voltage.

31. System according to claim 28, wherein the threshold circuits include a current comparator comparing current flow from the central station through said connecting cable means.

32. System according to claim 31, wherein said alarm signal transfer means includes current generating circuit means connected to said connecting cable means and controlling current flow to the circuit units in sequential pulses to energize indicators located at the respective sensing units in flashing or blinking mode, said current generating circuit means being connected to and controlling said current comparator circuit.

33. System according to claim 1, wherein said alarm signal transfer means includes current generating circuit means connected to said connecting cable means and controlling current flow to the circuit units in sequential pulses to energize indicators located at the respective sensing units in flashing or blinking mode.

34. System according to claim 33, wherein the interrupted pulse current generating means is connected to and controlled by the alarm signal processing stage to provide said interrupted current pulses as a function of response said alarm signal processing stage.

35. System according to claim 1, wherein the gas sensing unit comprises a sensing element (1002) and an electronic circuit network forming, at least in part, said threshold level means and said signal processing stages;

and wherein a self-monitoring circuit is provided sensing a condition of an operating parameter arising within said network which, upon malfunction, changes its condition from a first, or normal, level to another, or abnormal, level, and providing, respectively, a monitoring signal having characteristics representative of normal and abnormal conditions;

and circuit means responsive to said monitoring signal and providing a "malfunction" signal to said connecting cable means when the monitoring output signal has the characteristic representative of abnormal conditions.

36. System according to claim 35, including means for generating the malfunction signal, applied to the connecting cable means, in form of a signal which has a characteristic level different from the level of the output signal applied by one of the signal processing stages.

37. System according to claim 35, wherein the low level signal processing stage provides a signal of a first characteristic upon non-response of the sensor;

a signal of a second characteristic upon response of the gas sensor and the low level threshold sensing means;

and a signal of a third characteristic when the "malfunction" signal is provided.

38. System according to claim 1, wherein the gas sensing unit includes an electronic circuit network forming, at least in part, said threshold level means and said signal processing stages;

and an integrating circuit is provided, connected to said connection cable means and providing an output representative of supply power at least to a portion of the electronic circuit network, integrated over a period of time which is long with respect to expected periodic variations or superposed modulation of supply power, to prevent spurious conditions occurring within said network.

39. System according to claim 38, wherein, in the central station, the alarm signal transfer means includes current generating circuit means connected to said connecting cable means and controlling current flow to the sensing units in sequential pulses to energize indicators located at the respective sensing units in flashing or blinking mode upon response of one of the sensing units at the alarm signal level;

and wherein the time constant of integration of said integrating circuit in the gas sensing units is long with respect to the repetition rate of the sequential pulses to prevent spurious conditions from arising in the networks of sensing units which have not responded at the alarm level.

40. System according to claim 1, wherein each gas sensing unit includes an electronic circuit network forming, at least in part, said threshold level means and said signal processing stages;

response indicator means (1023) are provided positioned at said gas sensing units, and indicating response of the respective unit;

and an OR-gate (1033, 1034) connected to the outputs of the signal processing stages, and having its output connected to the indicator to provide an output indication therefrom upon response to either one of said stages (6, 7).

41. System according to claim 40, further including a sensing unit monitoring circuit sensing a condition of an operating parameter arising within the network which, upon malfunction, changes its condition from a first, or normal, level to another, abnormal, level, and providing, respectively, a monitoring signal having characteristics representative, respectively, of normal and abnormal condition;

and coupling means connecting the output from the monitoring circuit to said OR-gate (1033, 1034).

42. System according to claim 41, further including controlled circuit bypass means (1011) connected to bypass an energization signal applied to said OR-gate and suppress indication of said indicator upon enabling of said bypass means;

said network including means (1009, 1090) periodically enabling said control bypass means to provide a flashing output indication of said indicator means upon periodic enabling and not-enabling of said bypass means.

43. System as claimed in claim 1, further comprising a self-monitoring circuit connected to said central station and sensing a condition of an operating parameter occurring in a circuit network of said central station, the cable means, and the sensing units independently of gas-dependent output signals from the sensing units, which upon malfunction of said network or said cable means or gas sensing units, changes its condition to another, or abnormal condition, and providing, respectively, a monitoring signal having characteristics representative, respectively, of normal or abnormal condition;

and circuit means responsive to said monitoring signal and providing a "malfunction" signal to a means for producing a malfunction signal (1023; $U,S_1$) when the monitoring output signal has a characteristic representative of the abnormal condition to signal a malfunction which occurred within the sensing unit.

44. System according to claim 43, further including an integrating circuit connected to and forming part of said network and providing an output representative of supply power normally supplied to said network and integrated over a period of time which is long with respect to possible and expected variations or superimposed modulations occurring within the supply power to prevent spurious abnormal conditions from arising within said network.

* * * * *